US006177911B1

(12) United States Patent
Yuda et al.

(10) Patent No.: US 6,177,911 B1
(45) **Date of Patent: *Jan. 23, 2001**

(54) MOBILE RADIO ANTENNA

(75) Inventors: Naoki Yuda; Koichi Ogawa, both of Hirakata; Yasuhiro Otomo, Tokyo; Hiroyuki Nakamura, Neyagawa; Masaaki Yamabayashi, Tsuyama, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/800,804

(22) Filed: Feb. 18, 1997

(30) Foreign Application Priority Data

Feb. 20, 1996 (JP) ..... 8-031551
Feb. 20, 1996 (JP) ..... 8-031552
May 30, 1996 (JP) ..... 8-136020

(51) Int. Cl.[7] ..... H01Q 19/00

(52) U.S. Cl. ..... 343/792; 343/790; 343/791; 343/817

(58) Field of Search ..... 343/790, 791, 343/792, 793, 800, 817, 818, 833; H01Q 19/00

(56) References Cited

U.S. PATENT DOCUMENTS 4,509,056 * 4/1985 Ploussios ..... 343/792
4,937,588 * 6/1990 Austin ..... 343/792
4,963,879 * 10/1990 Lin ..... 343/792
5,079,562 * 1/1992 Yarsunas et al. ..... 343/792
5,506,591 * 4/1996 Dienes ..... 343/792
5,751,253 * 5/1998 Wells ..... 343/749

FOREIGN PATENT DOCUMENTS 2-147916 12/1990 (JP) .
3-126665 4/1991 (JP) .
3-322621 12/1991 (JP) .
5-160630 6/1993 (JP) .
6-272540 11/1994 (JP) .
2-545663 8/1996 (JP) .

* cited by examiner

*Primary Examiner*—Don Wong
*Assistant Examiner*—Tho Phan
(74) *Attorney, Agent, or Firm*—Morrison & Foerster LLP

(57) ABSTRACT

A narrow and light mobile radio antenna that requires convenient supporting metal fittings provided in a base station is provided. An inner conductor of a coaxial feed line extends upward by a length of ¼ wavelength from the upper end of an outer conductor. This extended inner conductor forms an antenna element. Outside the coaxial feed line, a ¼-wavelength sleeve-like metal pipe made of brass is located with one end connected to the upper end of the outer conductor. On a part of the inner surface of the open end of the metal pipe, an internal thread is formed by tapping. In the open end of the metal pipe, an insulating spacer having an external thread formed around its periphery is inserted. In other words, the insulating spacer is located between the inner wall of the metal pipe and the outer conductor of the coaxial feed line. At the lower end of the coaxial feed line, a coaxial connector for connection with an external circuit is provided.

19 Claims, 17 Drawing Sheets

MOBILE RADIO ANTENNA

FIELD OF THE INVENTION

The present invention relates to an antenna for a base station used in mobile radio.

BACKGROUND OF THE INVENTION

A dipole antenna called a "sleeve antenna" has been used as an antenna for a base station in mobile radio. In FIG. 15, an example of a sleeve antenna in the prior art is illustrated (see, for example, Laid-open Japanese Patent Application No. (Tokkai hei) 8-139521). As shown in FIG. 15, outside an outer conductor 50*a* of a coaxial feed line 50, a ¼-wavelength sleeve-like metal pipe 51 is located with one end connected to the upper end of outer conductor 50*a*. Also, an inner conductor 50*b* of coaxial feed line 50 protrudes from the upper end of outer conductor 50*a*, and a ¼-wavelength antenna element 52 is connected to the protruding inner conductor 50*b*. Thus, a ½-wavelength dipole antenna 53 is formed. Also, another example of a sleeve antenna is disclosed in Laid-open Japanese Patent Application No. (Tokkai hei) 4-329097, and it has a structure as shown in FIG. 16. In FIG. 16, a dipole antenna 57 comprises an antenna element 55 formed by extending an inner conductor 55 of a coaxial feed line 54 upward by a length corresponding to about a ¼ wavelength from the upper end of an outer conductor, and a ¼-wavelength sleeve-like metal pipe 56 located outside coaxial feed line 54 with one end connected to the upper end of the outer conductor. A passive element 59 is supported by a supporting means mounted to metal pipe 56.

Also, a "colinear array antenna", a vertically polarized plane wave omnidirectional antenna having a large gain, has been used as an antenna for a base station in mobile radio. A colinear array antenna in the prior art is disclosed in Laid-open Japanese Utility Model Application No. (Tokkai hei) 2-147916, and has a structure as shown in FIG. 17. In FIG. 17, in an outer conductor 60*a* of a coaxial feed line 60, an annular slit 61 is provided at predetermined spacing. Outside outer conductor 60*a* of coaxial feed line 60, a pair of ¼-wavelength sleeve-like metal pipes 62 is located on both sides of each annular slit 61. Thus, a plurality of dipole antenna elements 63 are formed. Between the lowest dipole antenna element 63 and an input terminal 64, a plural-stage ¼-wavelength impedance conversion circuit 65 is provided for impedance matching. Also, in FIG. 17, 60*b* denotes an inner conductor of coaxial feed line 60.

In the sleeve antenna as shown in FIG. 15, the coaxial feed line does not affect the antenna characteristics when the antenna is used as a vertically polarized plane wave antenna. However, the sleeve-like metal pipe forms a balun, and therefore the antenna is a narrow band antenna. Thus, the antenna must be adjusted to have a band that is sufficiently broader than a desired band in view of a difference in the resonance frequency of the antenna that may result due to a variation in the size of a component and a variation in finished size in the manufacturing process. In this case, making the diameter of a sleeve-like metal pipe large is one way to implement a broad band. However, if the diameter of the sleeve-like metal pipe is large, the antenna becomes heavier, and therefore supporting metal fittings provided in a base station become large.

In the sleeve antenna as shown in FIG. 16, a directional pattern can be set in any direction by the passive element. Therefore, the antenna is an antenna for a base station that is effective in covering only the range of a specific direction in indoor location, for example. However, in the above structure, the dipole antenna and the passive element are exposed, and therefore the structure is not sufficient for weather resistance and mechanical strength in outdoor location. Furthermore, this structure requires a supporting means for the passive element, and therefore the manufacturing is troublesome.

Generally, in a colinear array antenna having a large gain that is used in a base station, a standing wave ratio (SWR) in a used frequency band is required to be 1.5 or less. In order to implement this, a plural-stage ¼-wavelength impedance conversion circuit is provided to perform impedance matching in the conventional structure as mentioned above (FIG. 17). Therefore, the structure is complicated, and the entire length of the antenna is long. These problems are factors that prevent the small size and low cost for a base station, while base stations are increasingly installed for securing the number of channels for mobile radio.

SUMMARY OF THE INVENTION

The present invention seeks to provide a narrow and light mobile radio antenna that uses convenient supporting metal fittings provided in a base station.

Also, the present invention seeks to provide a mobile radio antenna that is suitable for outdoor location, has a simple structure, and is easily manufactured.

Furthermore, the present invention seeks to provide a colinear array antenna for mobile radio in which broad band matching characteristics can be obtained without using an impedance conversion circuit, and which has a small and simple structure.

A first structure of a mobile radio antenna according to the present invention comprises a dipole antenna having a coaxial feed line formed of an outer conductor and an inner conductor that are concentrically located with a dielectric therebetween, an antenna element formed by extending the inner conductor upward by a length corresponding to approximately a ¼ wavelength from the upper end of the outer conductor, and a ¼-wavelength sleeve-like conductor having a closed end and an open end located outside the coaxial feed line with the closed end connected to the outer conductor; and an insulating spacer interposed between an inner wall of the sleeve-like conductor and the coaxial feed line at the open end of the sleeve-like conductor; wherein the insulating spacer is configured to control a resonance frequency of the dipole antenna by adjusting an insertion depth of the insulating spacer. According to this first structure of the mobile radio antenna, a broad band can be implemented by changing the insertion depth of the insulating spacer, and therefore the diameters of the antenna element and the sleeve-like conductor can be optimized to minimize the size and weight of the antenna. As a result, a narrow and light mobile radio antenna that uses a convenient supporting metal provided in a base station can be implemented.

In the first structure of the mobile radio antenna of the present invention, an internal thread may be formed on a part of the inner wall of the sleeve-like conductor at the open end by tapping or drawing, and an external thread may be formed around a periphery of the insulating spacer. According to this example, the insertion depth of the insulating spacer can be readily controlled by a thread means comprising an internal thread and an external thread. In particular, according to the structure in which an internal thread is formed by drawing, a sleeve-like conductor having a thin thickness can be used. Therefore, a lighter mobile radio antenna can be implemented.

In the first structure of the mobile radio antenna of the present invention, a plurality of steps may be provided on a part of the inner wall of the sleeve-like conductor at the open end, and a tip end of the insulating spacer may be configured to form a snap fit with the open end of the sleeve-like conductor. According to this example, the mobile radio antenna in which the insertion depth of the insulating spacer does not change even if an external impact such as vibration is given can be implemented in a simple structure.

A second structure of a mobile radio antenna according to the present invention comprises a dipole antenna having a coaxial feed line formed of an outer conductor and an inner conductor that are concentrically located with a dielectric therebetween, an annular slit provided in a predetermined position of the outer conductor as a feed point, and a pair of ¼-wavelength sleeve-like conductors each having an open end and a closed end with their closed ends opposed and connected to both sides of the annular slit of the outer conductor; and a pair of insulating spacers interposed between inner walls of the pair of sleeve-like conductors and the coaxial feed line at the open ends of the sleeve-like conductors; wherein the pair of insulating spacers are configured to control a resonance frequency of the dipole antenna by adjusting insertion depths of the pair of insulating spacers. According to this second structure of the mobile radio antenna, a broad band can be implemented by changing the insertion depth of each insulating spacer. Therefore, the diameter of the sleeve-like conductor can be optimized to minimize the size and weight of the antenna. As a result, a narrow and light mobile radio antenna that uses a convenient supporting metal provided in a base station can be implemented.

In the second structure of the mobile radio antenna of the present invention, an internal thread may be formed on a part of the inner wall of the sleeve-like conductor at the open end by tapping or drawing, and an external thread may be formed around a periphery of the insulating spacer.

In the second structure of the mobile radio antenna of the present invention, a plurality of steps may be provided on a part of the inner wall of the sleeve-like conductor at the open end, and a tip end of the insulating spacer may be configured to form a snap fit with the open end of the sleeve-like conductor.

A third structure of a mobile radio antenna according to the present invention comprises, when the mobile radio antenna of the first structure of the present invention is a first mobile radio antenna, and the mobile radio antenna of the second structure of the present invention is a second mobile radio antenna, the first mobile radio antenna; and at least one second mobile radio antenna connected to the insulating spacer side of the first mobile radio antenna. According to this third structure of the mobile radio antenna, by controlling the insertion depth of the insulating spacer, the resonance frequencies of all dipole antennas can be adjusted to make the characteristics of each dipole antenna the same. As a result, the diameters of the antenna element and all sleeve-like conductors can be optimized to minimize the size and weight of the antenna. Therefore, a colinear array antenna for mobile radio that is narrow and light and uses convenient supporting metal fittings provided in a base station can be implemented.

A fourth structure of a mobile radio antenna according to the present invention comprises a coaxial feed line formed of an outer conductor and an inner conductor that are concentrically located with a dielectric therebetween; at least one dipole antenna fed by the coaxial feed line; at least one passive element located near the dipole antenna; and a radome covering the dipole antenna and the passive element; wherein the passive element is supported by the radome. According to this fourth structure of the mobile radio antenna, the dipole antenna and the passive element can be protected, and a simple structure that does not require a specialized supporting means for supporting a passive element can be made. Therefore, a mobile radio antenna that is suitable for outdoor location and is easily manufactured can be implemented.

In the fourth structure of the mobile radio antenna of the present invention, it is preferable that the radome is formed in a cylindrical shape extending in the longitudinal direction of the dipole antenna, that a bottom wall of the radome is fixed to a lower end part of the coaxial feed line, and that a tip end part of the dipole antenna is inserted in a recess provided on a top wall of the radome. According to this preferred example, the dipole antenna can be supported by the radome. Therefore, the characteristic change due to the displacement of the dipole antenna and the passive element can be prevented.

In the fourth structure of the mobile radio antenna of the present invention, it is preferable that the dipole antenna comprises an antenna element formed by extending the inner conductor of the coaxial feed line upward by a length corresponding to approximately a ¼ wavelength from an upper end of the outer conductor, and a ¼-wavelength sleeve-like conductor located outside the coaxial feed line with one end of the sleeve-like conductor connected to the upper end of the outer conductor.

In the fourth structure of the mobile radio antenna of the present invention, it is preferable that the dipole antenna comprises an annular slit provided in a predetermined position of the outer conductor of the coaxial feed line as a feed point, and a pair of ¼-wavelength sleeve-like conductors each having an open end and a closed end with their closed ends opposed and connected to the outer conductor on both sides of the annular slit.

In the fourth structure of the mobile radio antenna of the present invention, the passive element may be a metal body adhered to an inner wall surface of the radome.

In the fourth structure of the mobile radio antenna of the present invention, the passive element may be a metal body integrally formed in the radome.

In the fourth structure of the mobile radio antenna of the present invention, the passive element may be a metal body formed on an inner wall surface of the radome by printing or plating.

In the fourth structure of the mobile radio antenna of the present invention, the passive element may be formed by affixing a resin film on which a metal body is formed by printing or plating to an inner wall surface of the radome. According to this preferred example, a plurality of passive elements can be formed together, and therefore the size accuracy can be improved.

A fifth structure of a mobile radio antenna according to the present invention comprises a coaxial feed line formed of an outer conductor and an inner conductor that are concentrically located with a dielectric therebetween; a plurality of annular slits provided in the outer conductor at predetermined spacing; and a plurality of antenna elements formed by locating a pair of ¼-wavelength sleeve-like conductors each having an open end and a closed end with their closed ends opposed and connected to both sides of each of the plurality of annular slits; wherein a characteristic impedance of the coaxial feed line changes along a length of the feed line with at least one of the plurality of annular slits as a border. According to this fifth structure of the mobile radio antenna, the characteristic impedance of the coaxial feed line can be set to an optimal value, corresponding to the radiation impedances of the respective antenna elements, with at least one of the annular slits that are the respective feed points of the plurality of antenna elements as a border. As a result, broad band matching characteristics can be obtained without using an impedance conversion circuit, and a colinear array antenna having a small and simple structure can be implemented.

In the fifth structure of the mobile radio antenna of the present invention, the plurality of antenna elements may have at least one passive element provided for each.

In the fifth structure of the mobile radio antenna of the present invention, the characteristic impedance from one end of the coaxial feed line to an annular slit that is the nearest to the one end of the coaxial feed line is set as a standard impedance, and the characteristic impedance from the annular slit that is the nearest to the one end of the coaxial feed line to the other end of the coaxial feed line may be lower than the standard impedance. According to this preferred example, the following function effects can be obtained. The input impedance of the colinear array antenna is the sum of the radiation impedances of individual antenna elements. Therefore, when impedance matching is performed by making the input impedance equal to the standard impedance, the radiation impedances of individual antenna elements must be lower than the standard impedance. As a result, according to this preferred example, by lowering the characteristic impedance from the annular slit that is the nearest to the one end of the coaxial feed line to the other end of the coaxial feed line below the standard impedance, corresponding to the radiation impedances of individual antenna elements, broad band impedance matching characteristics can be obtained. Also, in this case, the characteristic impedance from the annular slit that is the nearest to the one end of the coaxial feed line to the other end of the coaxial feed line may be constant. According to this example, optimal matching conditions can be obtained when the respective radiation impedances of the plurality of antenna elements are approximately the same.

BRIEF DESCRIPTION OF THE DRAWINGS

FIG. 1(*b*) is a cross-sectional view taken on line A—A of FIG. 1(*a*);

FIG. 6(*b*) is its vertical cross-sectional view;

DETAILED DESCRIPTION OF THE INVENTION

The present invention will be described below in more detail by way of embodiments.

First Embodiment

Figure 1A:
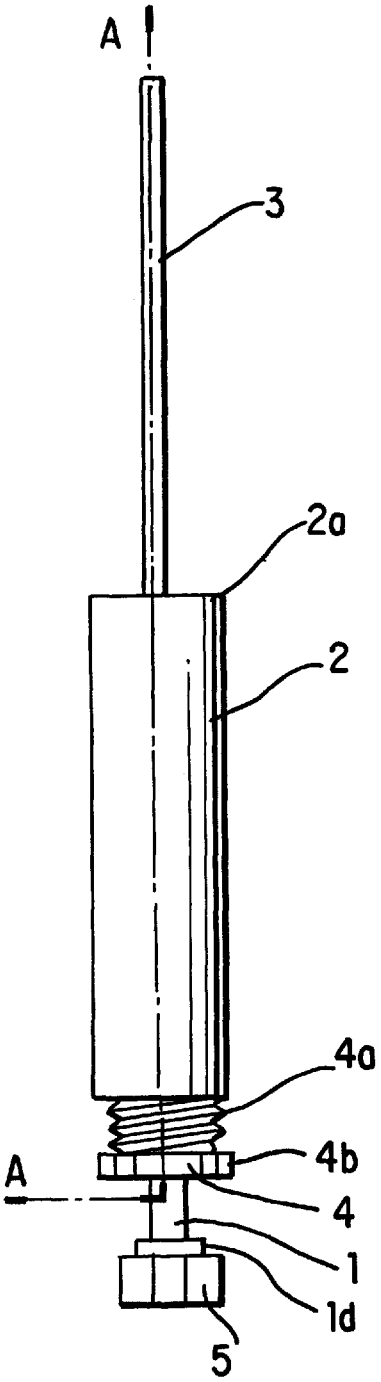
FIG. 1(*a*) is a side view of a first embodiment of a mobile radio antenna according to the present invention.
Figure 1B:
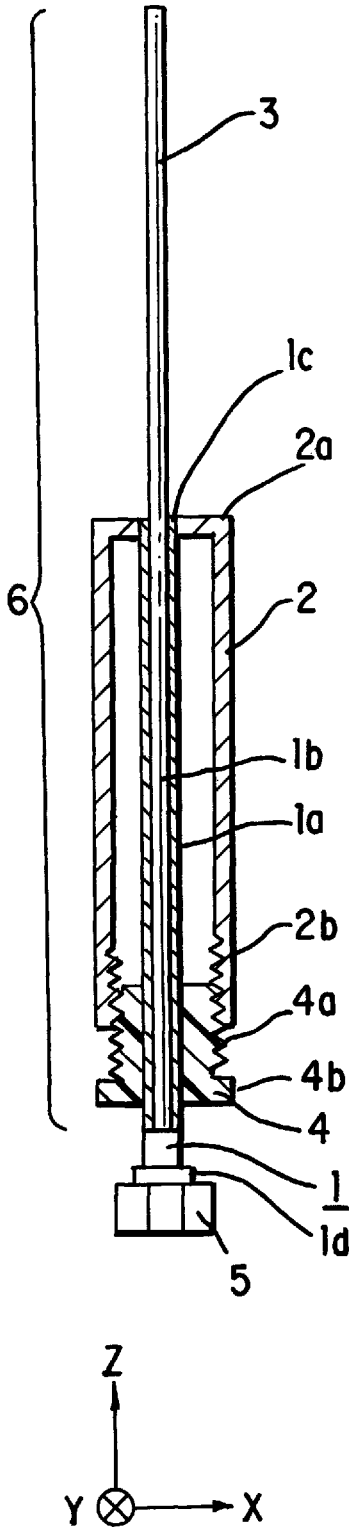

FIG. 1(*a*) is a side view of a first embodiment of a mobile radio antenna according to the present invention. FIG. 1(*b*) is a cross-sectional view taken on line A—A of FIG. 1(*a*).

As shown in FIG. 1, a coaxial feed line 1 comprises an outer conductor 1*a* and an inner conductor 1*b* which are concentrically located with a dielectric therebetween, and inner conductor 1*b* extends upward by a length corresponding to a ¼ wavelength from an upper end 1*c* of outer conductor 1*b*. This extended inner conductor 1*b* forms an antenna element 3. Outside coaxial feed line 1, a ¼ wavelength, sleeve-like metal pipe 2 made of brass is located with one end connected to upper end 1*c* of outer conductor 1*a*. At the open end of metal pipe 2, an internal thread 2*b* is formed on a part of its inner periphery by tapping. In the open end of metal pipe 2, an insulating spacer 4 made of fluororesin (for example, polytetrafluoroethylene) with an external thread 4*a* formed around its periphery is inserted. In other words, insulating spacer 4 is located between the open end side inner wall of metal pipe 2 and the outer conductor 1*a* of coaxial feed line 1. In the base end part of insulating spacer 4, a stopper and turn knob 4*b* is formed. Thus, insulating spacer 4 can be threaded into the open end of metal pipe 2 by a predetermined length (insertion depth). At lower end 1*d* of coaxial feed line 1, a coaxial connector 5 for connection to an external circuit is provided. In this example, antenna element 3 has a diameter of 2 mm and a length of 36 mm. Metal pipe 2 has a diameter of 8 mm and a length of 36 mm. The length of the insertion part of insulating spacer 4 is 36 mm. Thus, a ½-wavelength dipole antenna 6 at a frequency of 1.9 GHz, that is, a mobile radio antenna, is formed.

Figure 2:
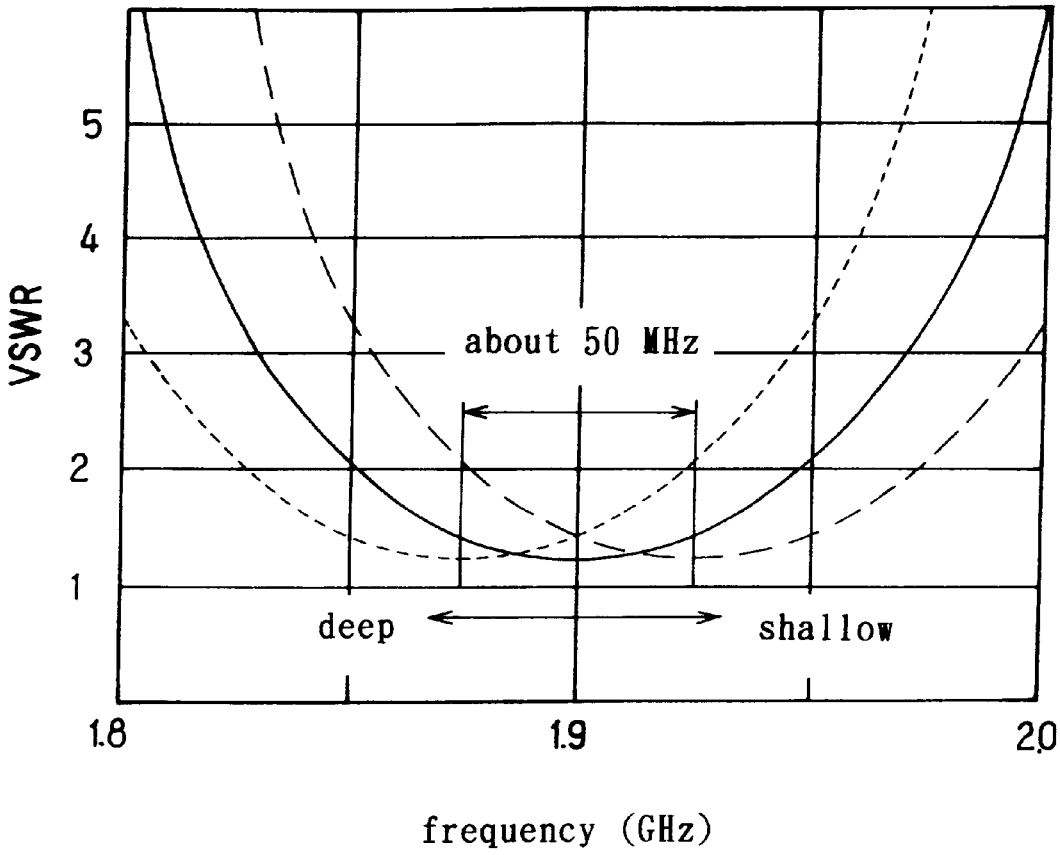
FIG. 2 is a frequency band characteristic graph showing the change of VSWR (voltage standing wave ratio) with a parameter of the insertion amount of the insulating spacer in the first embodiment of the present invention.

FIG. 2 is a frequency band characteristic graph showing the change of VSWR (voltage standing wave ratio) characteristics with a parameter of the insertion amount of insulating spacer 4. As seen from FIG. 2, by the insertion of insulating spacer 4, the capacitive load in series with the dipole antenna increases to decrease the resonance frequency, which is equivalent to electrically extending the length of the dipole antenna. As the insertion depth of insulating spacer 4 is increased, the resonance frequency decreases. As the insertion depth of insulating spacer 4 decreases, the resonance frequency increases. In other words, by changing the insertion depth of insulating spacer 4, the resonance frequency can be adjusted. The adjustment range is about 50 MHz, and the bandwidth ratio is 2.6 %, which are wide enough for correcting a difference in the resonance frequency due to variation in the size of a component or variation in finished size in the manufacturing process.

As mentioned above, according to this embodiment, a broad band can be implemented by changing the insertion depth of insulating spacer 4. Therefore, the diameters of antenna element 3 and metal pipe 2 can be optimized to minimize the size and weight of the antenna. As a result, a narrow and light mobile radio antenna that uses convenient supporting metal fittings provided in a base station can be implemented.

The resonance frequency can be readily adjusted over a broad band as mentioned above. Therefore, base stations for various mobile radio communication systems that have been proposed recently and put to practical use can use the same antenna tuned to different frequencies. As a result, the lower cost due to mass production is possible.

Here, examples of 1.9 GHz band systems and their frequency bands are shown.

| Nation | System Name | Frequency Band |
|---|---|---|
| Japan | PHS | 1895–1918 MHz |
| North America | PCS (transmission) | 1850–1910 MHz |
| North America | PCS (reception) | 1930–1990 MHz |
| Europe | DECT | 1880–1900 MHz |

Second Embodiment

Figure 3:
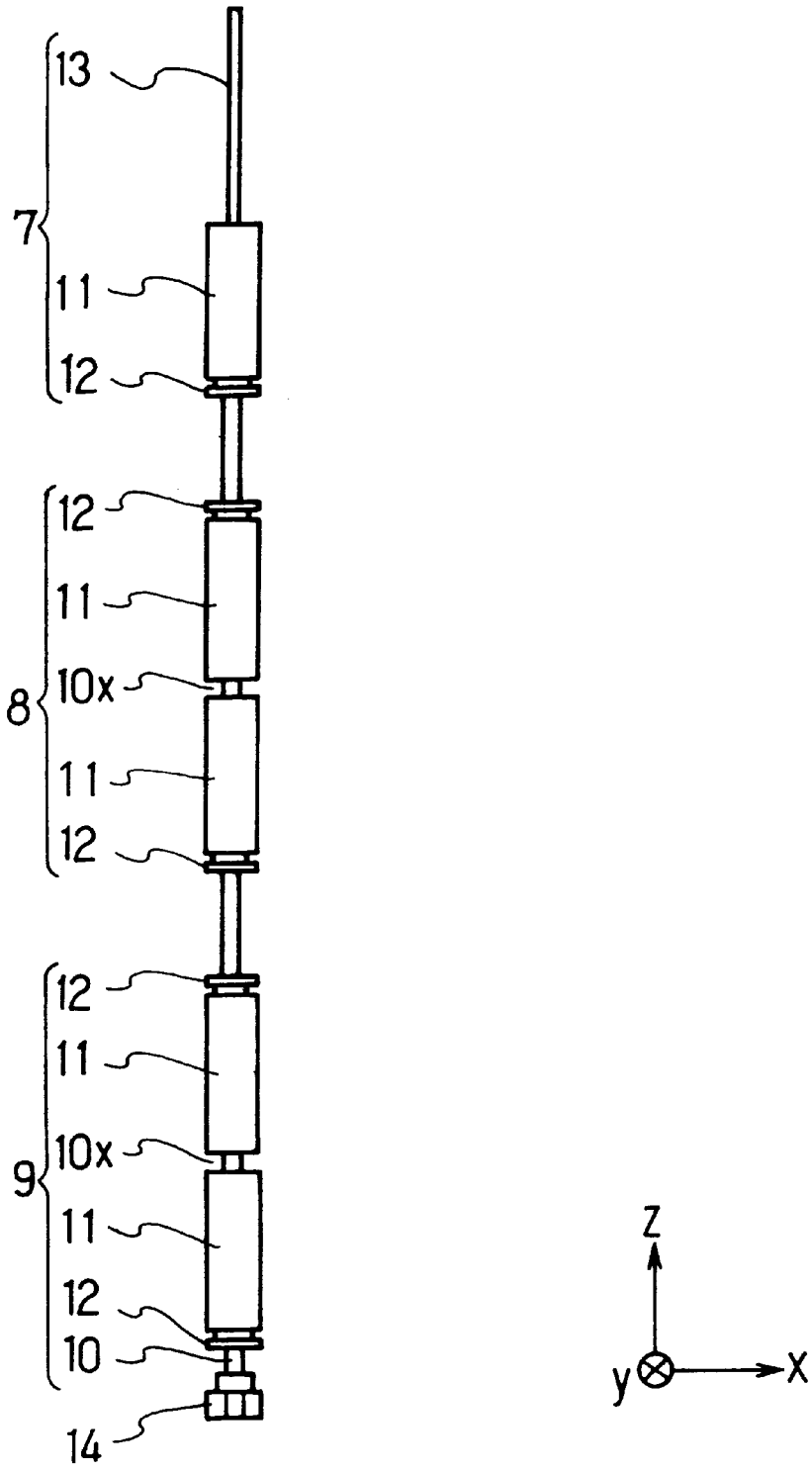
FIG. 3 is a side view of a second embodiment of a mobile radio antenna according to the present invention.

FIG. 3 is a side view of a second embodiment of a mobile radio antenna according to the present invention.

As shown in FIG. 3, under a first dipole antenna 7, a second dipole antenna 8 is connected, under which, a third dipole antenna 9 is connected. Thus, a colinear array antenna is formed.

In FIG. 3, first dipole antenna 7 has the same structure as in the above first embodiment, and the description will be omitted. Second and third dipole antennas 8 and 9 are formed as will be described below. In a predetermined position of the outer conductor of a coaxial feed line 10, a feed point is formed by providing an annular slit 10*x* having a width of 3 mm. Outside the outer conductor of coaxial feed line 10, a pair of ¼ wavelength, sleeve-like metal pipes 11 made of brass are located on both sides of annular slit 10*x*. In this example, the metal pipes 11 are connected to the outer conductor with their open ends facing away from the annular slit 10*x*. In the open end of each metal pipe 11, an insulating spacer 12 made of fluororesin (for example, polytetrafluoroethylene) similar to that of the first embodiment is inserted. This configuration of metal pipes 11 forms dipole antennas 8 and 9. A broad band can be implemented by changing the insertion depth of each insulating spacer, therefore the diameter of metal pipe 11 can be optimized to minimize the size and weight of the antenna.

Also, at the lower end of coaxial feed line 10 extended from under third dipole antenna 9, a coaxial connector 14 for connection to an external circuit is provided. In this example, antenna element 13 has a diameter of 2 mm and a length of 36 mm. Metal pipe 11 has a diameter of 8 mm and a length of 36 mm. The length of the insertion part of insulating spacer 12 is 3 mm.

Figure 4:
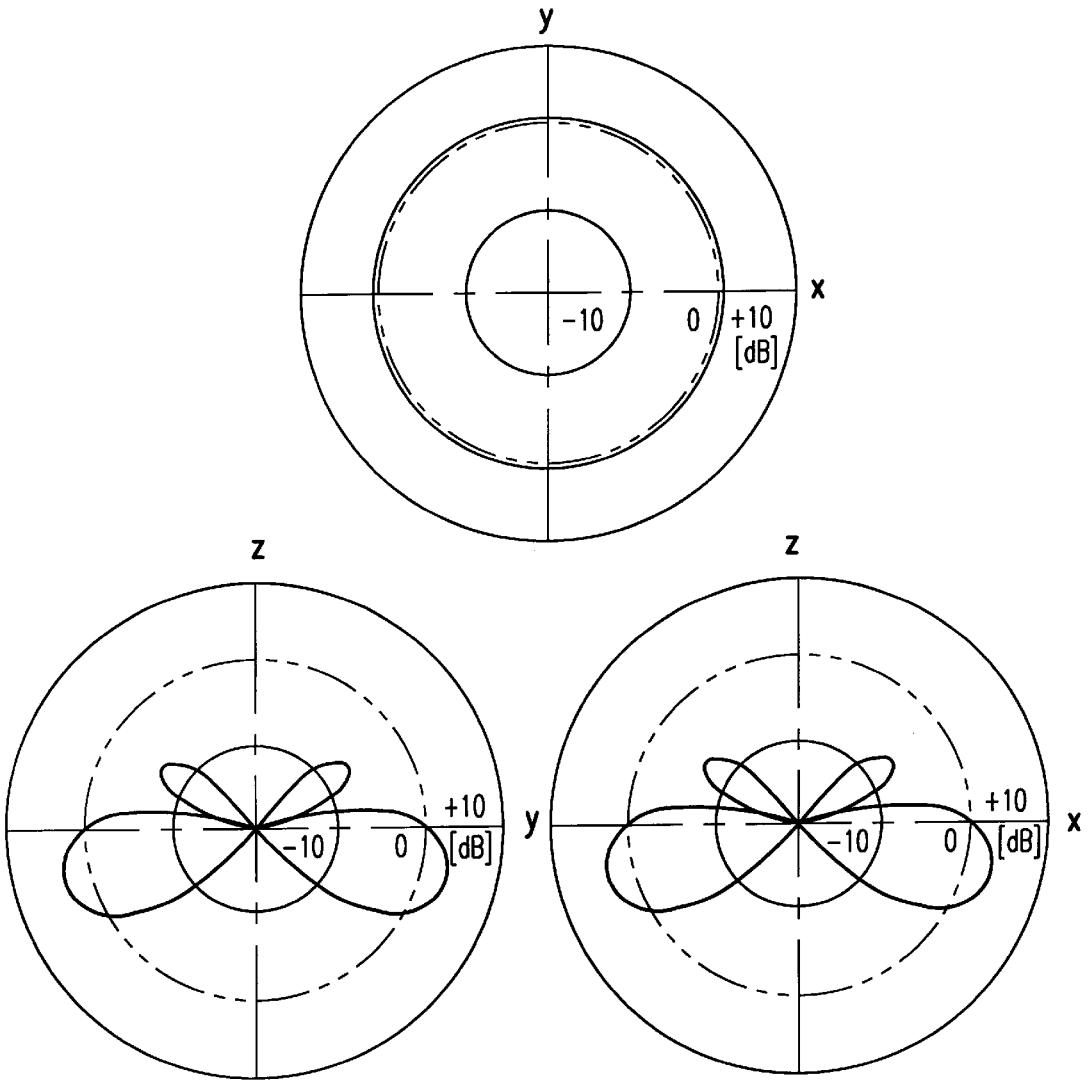
FIG. 4 shows the directivity characteristics of the antenna when the spacing between the feed points of the first, second and third dipole antennas is 91 mm in the second embodiment of the present invention.

FIG. 4 shows the directivity characteristics of the antenna when the spacing between the feed points of the first, second and third dipole antennas 7, 8 and 9 is 91 mm. The x, y and z axes correspond to those shown in FIG. 3. The directions of the largest gains in vertical planes (a yz plane and a zx plane) are tilted downward, and the tilt angles are about 15°. This spacing between the feed points is shorter than a length corresponding to 1 wavelength, and therefore the direction of the peak gain in the vertical planes is tilted downward as shown in FIG. 4. In other words, the wavelength in free space at 1.9 GHz: $\lambda_0=3\times10^8 m\cdot s^{-1}/1.9\times10^9 s^{-1}=157.9$ mm; the wavelength in the coaxial feed line at 1.9 GHz: $\lambda_g$ is approximately $\lambda_0\times0.67=105.8$ mm. Here, 0.67 indicates a wavelength shortening rate. Accordingly, the spacing between the feed points of the first, second and third dipole antennas 7, 8 and 9, 91 mm, is shorter than 105.8 mm, that is, the spacing between the feed points is shorter than 1 wavelength. When the spacing between the feed points is longer than 1 wavelength, the direction of the peak gain in the vertical planes is tilted upward. When the spacing between the feed points is approximately equal to 1 wavelength, the direction of the peak gain in the vertical planes is horizontal. In other words, the direction of the peak gain in the vertical planes (the yz plane and the zx plane) can be controlled by the spacing between the feed points. This is because the phase of the radio waves generated from the respective dipole antennas depends on the relationship between the spacing between the feed points and the wavelength of the radio wave in the coaxial feed line. These are useful features of the colinear array antenna that can be changed according to the application.

Figure 5:
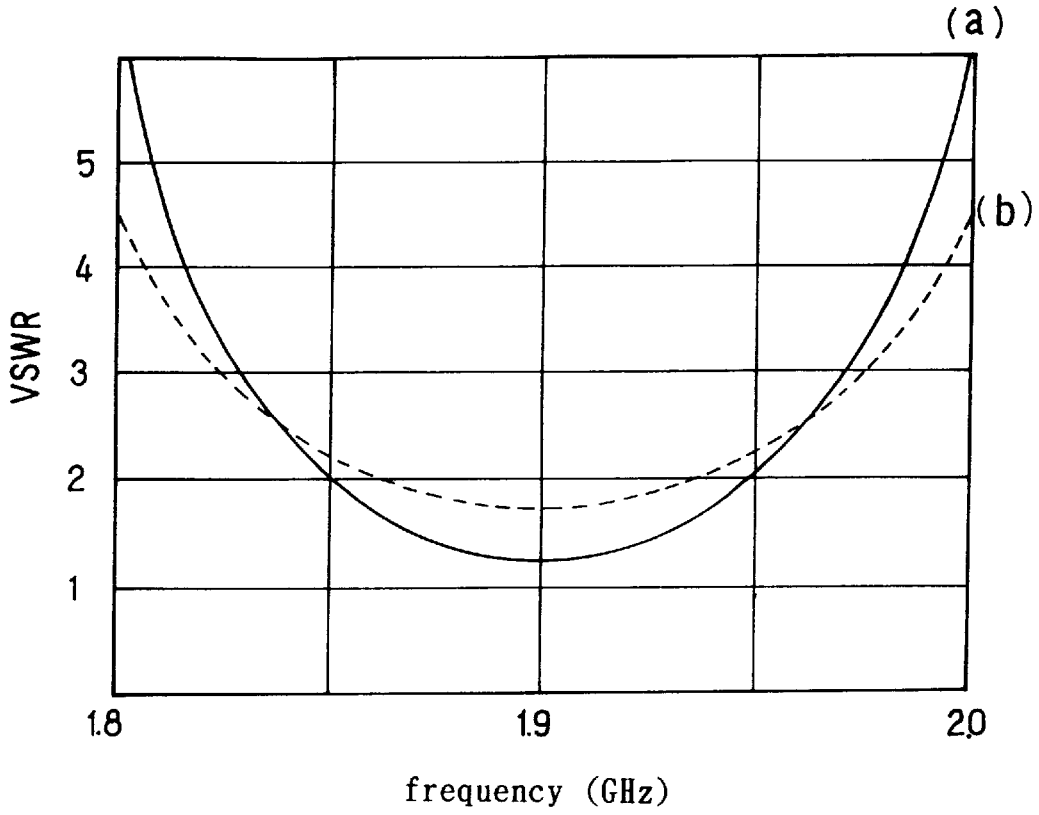
FIG. 5 is a VSWR (voltage standing wave ratio) characteristic graph showing the frequency band characteristics of the antenna when the spacing between the feed points of the first, second and third dipole antennas is 106 mm in the second embodiment of the present invention.

FIG. 5 is a VSWR characteristic graph showing the frequency band characteristics of the antenna when the spacing between the feed points of the first, second and third dipole antennas 7, 8 and 9 is 106 mm. In FIG. 5, (a) indicates the VSWR characteristics when the first, second and third dipole antennas 7, 8 and 9 all have a resonance frequency of 1.9 GHz, and (b) indicates the VSWR characteristics when the first, second and third dipole antennas 7, 8 and 9 resonate at 1.9 GHz, 1.85 GHz and 1.95 GHz respectively. As shown in FIG. 5, (b) has more degraded VSWR characteristics at a frequency of 1.9 GHz than (a). This is because the entire colinear array antenna is mismatched at 1.9 GHz, which is caused by the fact that the resonance frequencies of the second and third dipole antennas 8 and 9 deviate from 1.9 GHz.

As seen from FIG. 5, in order to optimize the characteristics of the colinear array antenna, it is preferable that all of the dipole antennas have the same characteristics. In this embodiment, by changing the insertion depth of insulating spacer 12, the resonance frequencies of all of the dipole antennas 7, 8 and 9 can be adjusted to make their characteristics essentially identical. As a result, the diameters of antenna element 13 and all metal pipes 11 can be optimized to minimize the size and weight of the antenna. Therefore, a colinear array antenna for mobile radio that is narrow and light and uses convenient supporting metal fittings provided in a base station can be implemented.

In this embodiment, there are three dipole antennas forming the colinear array antenna. However, the structure need not be limited to this structure, and the number of dipole antennas may be any number other than three. By increasing the number of dipole antennas, the peak gain of the colinear array antenna can be increased.

Also, in the above first and second embodiments, the internal thread is formed on the inner wall of the open end of the metal pipe by tapping. However, the method need not be limited to this method, and the internal thread may be formed by drawing the metal pipe, for example, so that a thinner metal pipe can be used and a lighter mobile radio antenna can be implemented.

Also, in the above first and second embodiments, an internal thread and an external thread is used as a means for controlling the insertion depth of the insulating spacer. However, the structure need not be limited to this structure, and a multi-step snap fit may be used, for example. In such a case, the step of the open end inner wall of the metal pipe may be saw-tooth-like or rectangular.

Also, in the above first and second embodiments, a fluororesin (for example, polytetrafluoroethylene) is used as the material of the insulating spacer. However, the material need not be limited to this material, and polyethylene, polypropylene, or ABS, for example, may be selected, considering the balance between required high-frequency characteristics and the permitivity. Generally, materials having good high-frequency characteristics have low permitivity and a narrow adjustment range of the resonance frequency with the same insertion depth. On the other hand, materials having bad high-frequency characteristics have high permitivity and a broad adjustment range of the resonance frequency with the same insertion depth.

Third Embodiment

Figure 6A:
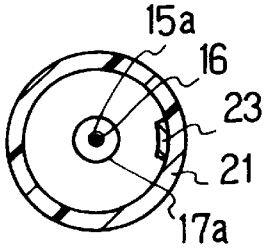
FIG. 6(*a*) is a transverse cross-sectional view of a third embodiment of a mobile radio antenna according to the present invention.
Figure 6B:
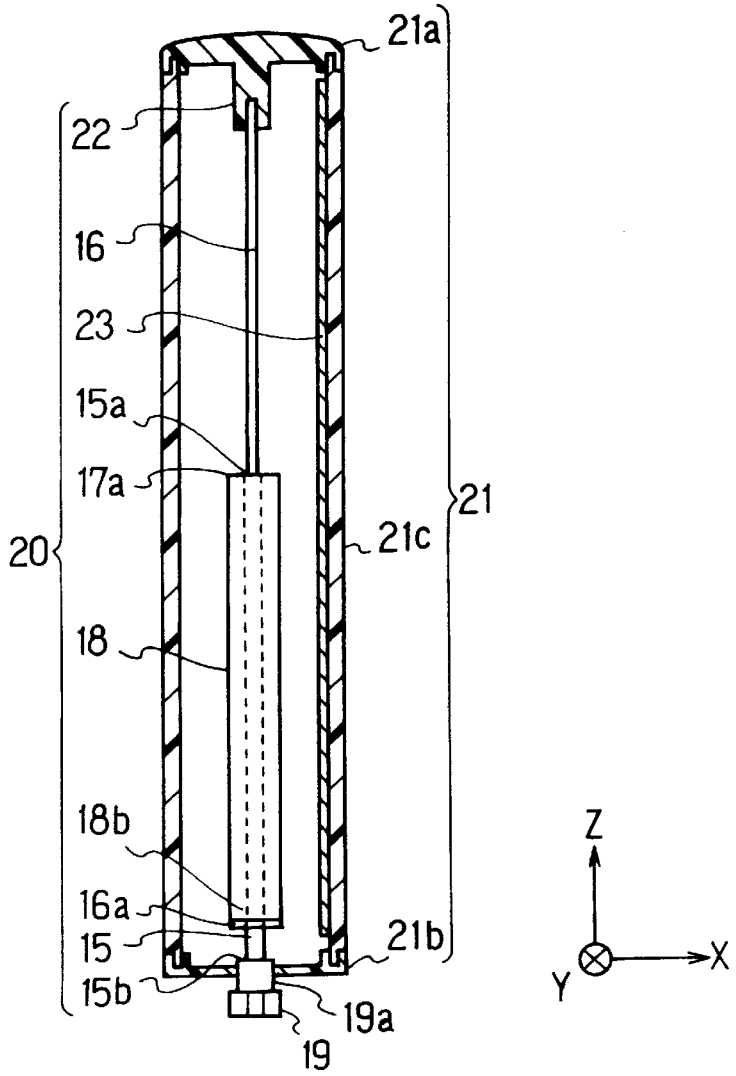

FIG. 6(*a*) is a transverse cross-sectional view of a third embodiment of a mobile radio antenna. FIG. 6(*b*) is its vertical cross-sectional view. As shown in FIG. 6, a coaxial feed line 15 comprises an outer conductor and an inner conductor which are concentrically located with a dielectric therebetween, and the inner conductor extends upward by a length corresponding to about a ¼ wavelength from an upper end 15*a* of the outer conductor. This extended inner conductor forms an antenna element 16. Outside coaxial feed line 15, a ¼-wavelength metal pipe 18 made of brass is located with one end 17*a* connected to upper end 15*a* of the outer conductor. In an open end 18*b* of metal pipe 18, a spacer 16*a* made of fluororesin (for example, polytetrafluoroethylene) is inserted between its inner wall and coaxial feed line 15, and therefore the other end 18*b* of metal pipe 18 is supported. At a lower end 15*b* of coaxial feed line 15, a coaxial connector 19 for connection to an external circuit is provided. Thus, a dipole antenna 20 is formed.

To a connector shell 19*a* of coaxial connector 19, the central part of a disk-like radome bottom cover 21*b* made of FRP is fixed by an adhesive. To radome bottom cover 21*b*, the lower end part of a cylindrical radome side wall 21*c* made of FRP is fixed, and therefore radome side wall 21*c* is located around dipole antenna 20. On the upper surface of radome bottom cover 21*b*, a groove part is provided along its periphery, and in this groove part, the lower end part of radome side wall 21*c* is fit and inserted. Thus, the sealing between radome bottom cover 21*b* and radome side wall 21*c* can be improved. To the upper end part of radome side wall 21*c*, a disk-like radome top cover 21*a* made of FRP is fixed. On the upper surface of radome top cover 21*a*, a groove part is provided along its periphery, and in this groove part, the upper end part of radome side wall 21*c* is fit and inserted. Thus, the sealing between radome side wall 21*c* and radome top cover 21*a* can be improved. As mentioned above, dipole antenna 20 is covered with a cylindrical radome 21. On the inner wall surface of radome side wall 21*c*, a copper sheet 23 is adhered by an adhesive. This copper sheet 23 functions as a passive element and determines the directivity characteristics of dipole antenna 20. Also, on the lower surface of radome top cover 21*a*, a protruding part 22 is provided in its center, and on the lower end surface of this protruding part 22, a recess is formed. In the recess, the upper end of antenna element 16 is inserted for support. Thus, the spacing between copper sheet 23, that is, the passive element, and dipole antenna 20 does not change due to an external impact or gravity.

As mentioned above, dipole antenna 20 and copper sheet 23, the passive element, are protected by a simple structure that does not require a supporting structure for the passive element. Therefore, a mobile radio antenna that is suitable for outdoor location and is readily manufactured can be implemented.

In this example, the diameter of antenna element 16 is 2 mm, the diameter of metal pipe 18 is 8 mm, and the lengths of both are 35 mm. Both form a ½-wavelength dipole antenna 20 at a frequency of 1.9 GHz, that is, a mobile radio antenna. The length of copper sheet 23, a passive element, is a factor for controlling the directivity characteristics in the horizontal plane (xy plane). When the length of copper sheet 23 is longer than a ½ wavelength, it operates as a reflector. When the length of copper sheet 23 is shorter than a ½ wavelength, it operates as a wave director. Also, the center-to-center distance between copper sheet 23 and dipole antenna 20 is a factor for determining the input impedance. When this distance is shorter, the input impedance is lower. When this distance is longer, the input impedance is higher. In this embodiment, the inside diameter of radome 21 is set to 30 mm, and the center-to-center distance between copper sheet 23 and dipole antenna 20 is set to 15 mm. Also, the recess provided on radome top cover 21*a* has a depth of 6 mm and a diameter of 2.2 mm.

Figure 7:
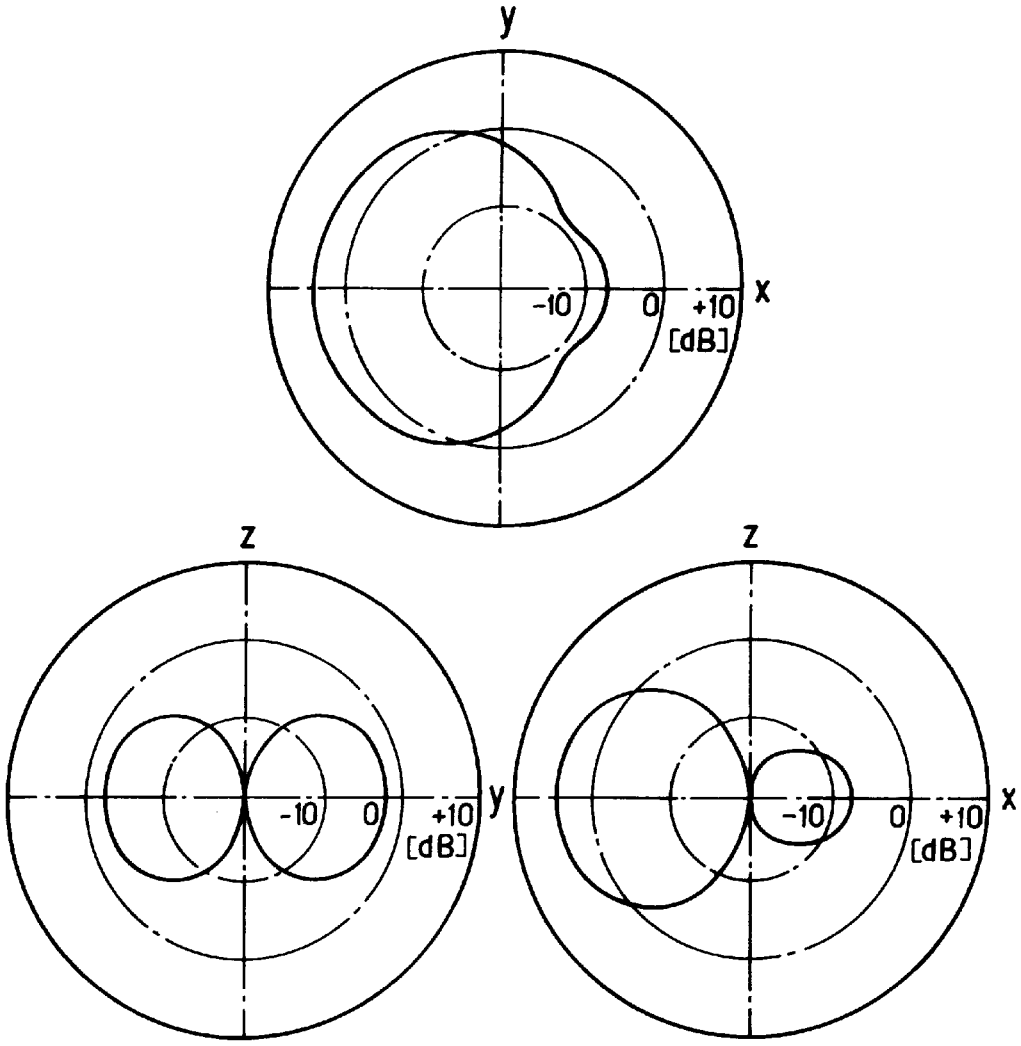
FIG. 7 shows the directivity characteristics of the antenna when the length, width, and thickness of the copper sheet, a passive element, are respectively 80 mm, 2 mm, and 0.2 mm in the third embodiment of the present invention.

FIG. 7 shows the directivity characteristics of the antenna when copper sheet 23 has a length of 80 mm, a width of 2 mm, and a thickness of 0.2 mm. The x, y and z axes correspond to FIG. 6. As shown in FIG. 7, the directivity characteristics in the horizontal plane (xy plane) is a pattern that is sectored in the direction of −x. In other words, sheet copper 23 functions as a passive element, and the directivity characteristics of the horizontal plane is controlled by its length. In this embodiment, the length of the passive element (copper sheet 23) is longer than a ½ wavelength, and therefore the passive element operates as a reflector. When the length of this passive element (copper sheet 23) is shorter than a ½ wavelength, the passive element operates as a wave director, and a pattern is formed that is sectored in the direction of +x, which is toward the passive element (copper sheet 23). These features can be employed according to the application in which the antenna is to be used.

Fourth Embodiment

Figure 8:
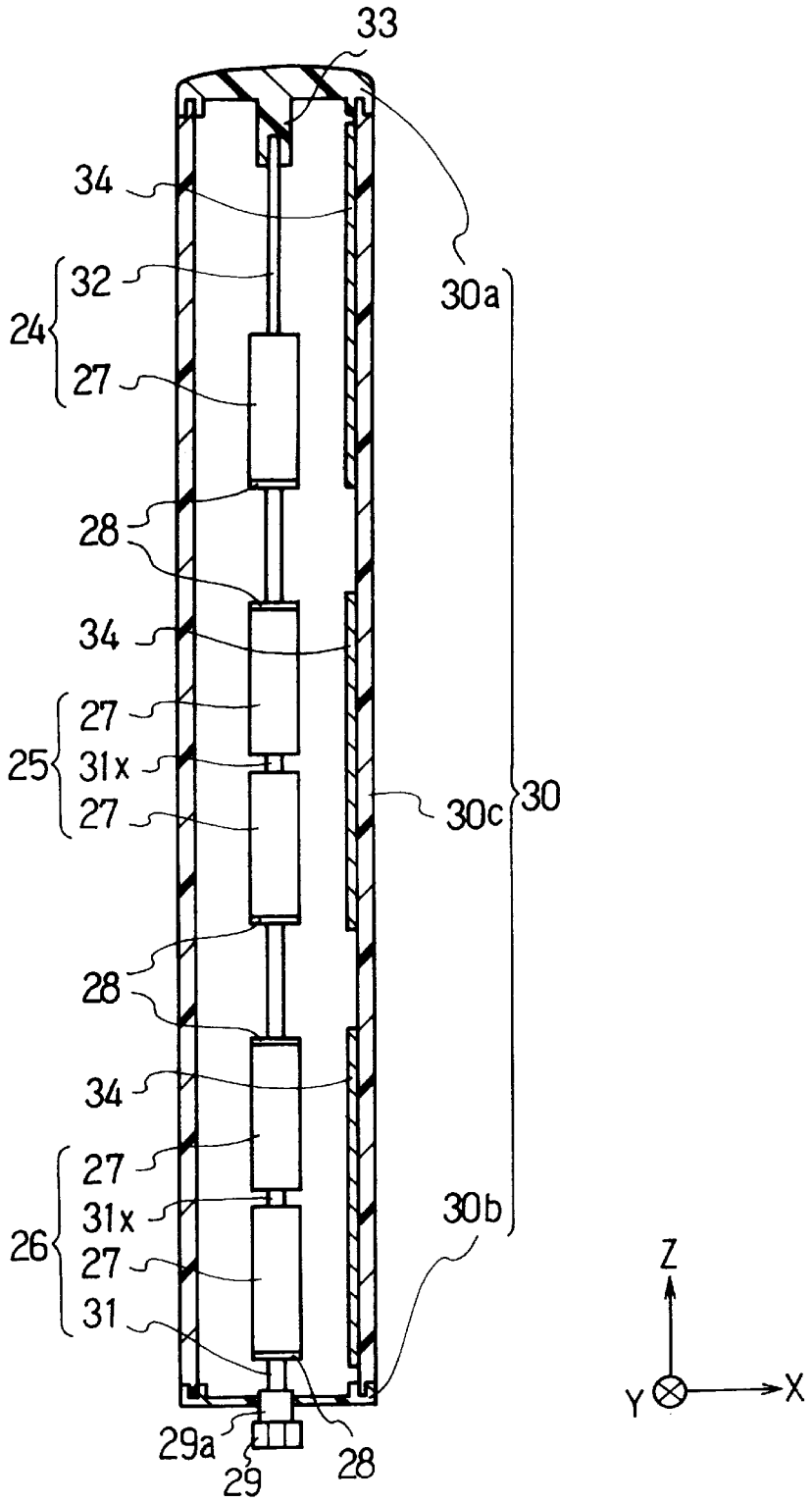
FIG. 8 is a vertical cross-sectional view of a fourth embodiment of a mobile radio antenna according to the present invention.

FIG. 8 is a vertical cross-sectional view showing a mobile radio antenna in a fourth embodiment. As shown in FIG. 8, under a first dipole antenna 24, a second dipole antenna 25 is connected, under which, a third dipole antenna 26 is connected. Thus, a colinear array antenna is formed.

In FIG. 8, the first dipole antenna 24 has the same structure as in the above third embodiment, and the description will be omitted. The second and third dipole antennas 25 and 26 are formed as will be described below. In a predetermined position of the outer conductor of a coaxial feed line 31, a feed point is formed by providing an annular slit 31*x* having, in this example, a width of 3 mm. Outside the outer conductor of coaxial feed line 31, a pair of ¼-wavelength metal pipes 27 are located on both sides of annular slit 31*x*. In this example, the metal pipes 27 are connected with their open ends facing away from the annular slit 31*x*. Also, in the open end of each metal pipe 27, a spacer 28 made of fluororesin (for example, polytetrafluoroethylene) is inserted between its inner wall and coaxial feed line 31, supporting the open end of metal pipe 27. These metal pipes are similar to metal pipe 18 in the above third embodiment (FIG. 6). At the lower end of coaxial feed line 31, a coaxial connector 29 for connection to an external circuit is provided.

To a connector shell 29*a* of coaxial connector 29, the central part of a disk-like radome bottom cover 30*b* made of FRP is fixed by an adhesive. To radome bottom cover 30*b*, the lower end part of a cylindrical radome side wall 30*c* made of FRP is fixed, and therefore radome side wall 30*c* is located around the colinear array antenna. The upper surface of radome bottom cover 30*b* has a groove part along its periphery, and in this groove part, the lower end part of radome side wall 30*c* is fit and inserted. Thus, the sealing between radome bottom cover 30*b* and radome side wall 30*c* can be improved. To the upper end part of radome side wall 30*c*, a disk-like radome top cover 30*a* made of FRP is fixed. The lower surface of radome top cover 30*a* has a groove part along its periphery, and in this groove part, the upper end part of radome side wall 30*c* is fit and inserted. Thus, the sealing between radome side wall 30*c* and radome top cover 30*a* can be improved. As mentioned above, the colinear array antenna is covered with a cylindrical radome 30. On the inner wall surface of radome side wall 30*c*, three copper sheets 34 are adhered by an adhesive corresponding to the first, second and third dipole antennas 24, 25 and 26. These copper sheets 34 function as passive elements and determine the directivity characteristics of the first, second and third dipole antennas 24, 25 and 26. Also, on the lower surface of radome top cover 30*a*, a protruding part 33 is provided in its center, and on the lower end surface of this protruding part 33, a recess is formed. In the recess, the upper end of antenna element 32 is inserted to support the colinear array antenna. Thus, the spacing between the three copper sheets 34, that is, passive elements, and the first, second and third dipole antennas 24, 25 and 26 does not change due to an external impact or gravity.

As mentioned above, according to this embodiment, the first, second and third dipole antennas 24, 25 and 26 and the three copper sheets 34, passive elements, can be protected using a simple structure that does not require a supporting means for supporting a passive element. Therefore, a mobile radio antenna suitable for outdoor locations and easily manufactured can be implemented.

Figure 9:
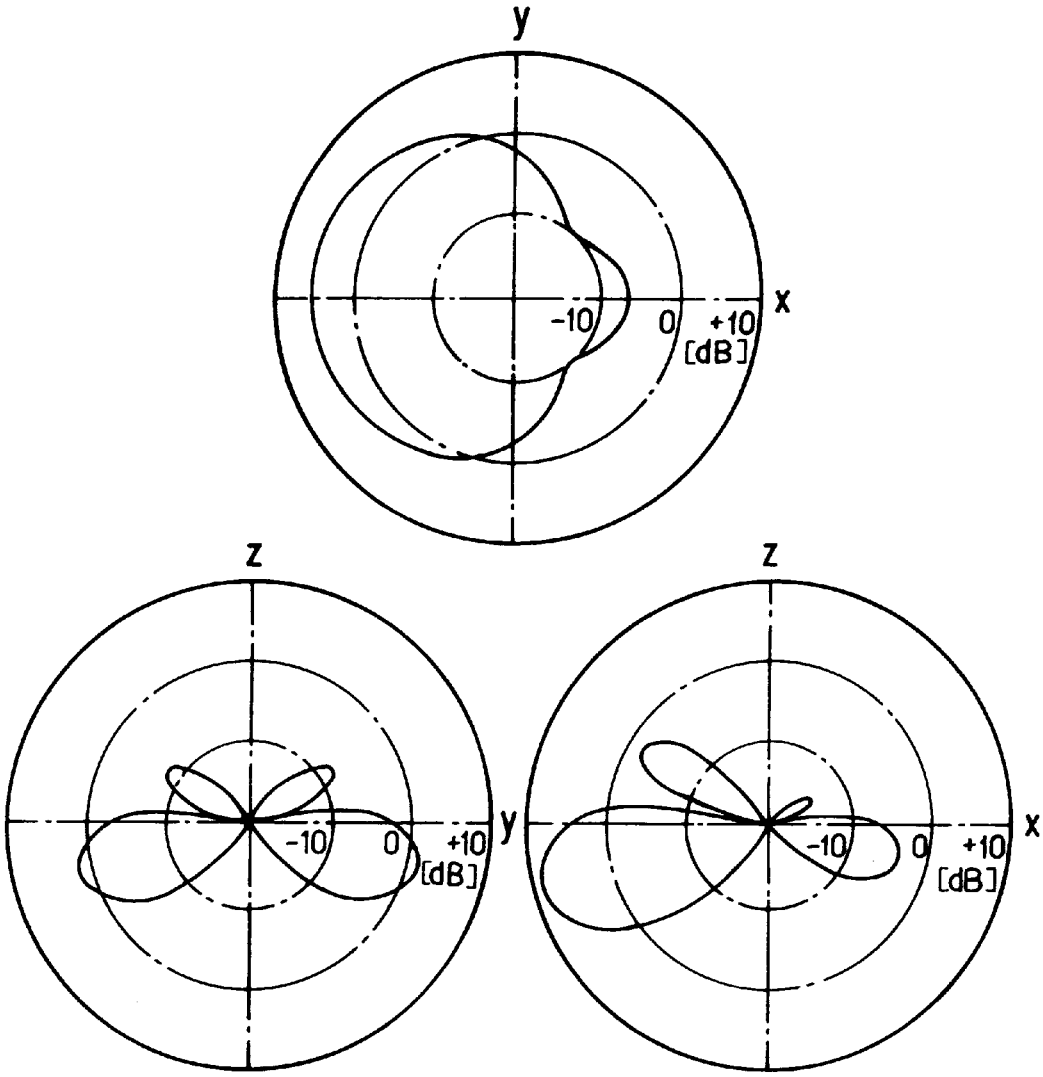
FIG. 9 shows the directivity characteristics of the antenna when the spacing between the feed points of the first, second and third dipole antennas is 91 mm in the fourth embodiment of the present invention.

FIG. 9 shows the directivity characteristics of the antenna when the spacing between the feed points of the first, second and third dipole antennas 24, 25 and 26 is 91 mm. The x, y and z axes correspond to FIG. 8. Also, the length, width, and thickness of copper sheet 34, a passive element, are set to 80 mm, 2 mm, and 0.2 mm respectively. As shown in FIG. 9, the direction of the peak gain in the vertical planes (yz plane and zx plane) is tilted downward, and the tilt angle is about 15°. This spacing between the feed points is shorter than 1 wavelength, and therefore the direction of the peak gain in the vertical planes is tilted downward as shown in FIG. 9. Also, when the spacing between the feed points is longer than 1 wavelength, the direction of the peak gain in the vertical planes is tilted upward. When the spacing between the feed points is about the same as 1 wavelength, the direction of the peak gain in the vertical planes is horizontal. In other words, the direction of the peak gain in the vertical planes (yz plane and zx plane) can be controlled by the spacing between the feed points. This is because the phase of the radio waves generated from the respective dipole antennas is changed by the relationship between the spacing between the feed points and the wavelength of the radio wave in the coaxial feed line. These are the useful features of the colinear array antenna and should be employed according to the application. Also, similar to the above third embodiment, copper sheet 34 functions as a passive element, and that the directivity characteristics in the horizontal plane (xy plane) is a pattern that is sectored in the direction of −x.

Also, in this embodiment, three dipole antennas are used to form the colinear array antenna. However, the structure need not be limited to this structure, and the number of dipole antennas may be two, or four or more. If the number of dipole antennas is increased, the peak gain of the colinear array antenna can be increased.

In the above third and fourth embodiments, copper sheet 23 (or 34) which is adhered to the inner wall surface of radome 21 (or 30) is used as a passive element. However, the structure need not be limited to this structure, and a metal body that is integrally formed in the radome may be used as a passive element. Also, a metal body in which a conducting ink is patterned on the inner wall surface of the radome by decalcomania, or a metal body in which the surface of the printed pattern is plated with a metal may be used as a passive element. Furthermore, when the passive element is formed by affixing a resin film on which a metal body is formed by printing or plating to the inner wall surface of the radome, the function similar to that in the case of directly printing on the inner wall surface of the radome can be achieved. In this last case, there is an advantage that a cheap method such as screen printing can be used. Also, in this case, there is another advantage that a plurality of passive elements can be formed together, and that the size accuracy can be improved.

Also, in the above third and fourth embodiments, one passive element is provided for each dipole antenna, however, a plurality of passive elements may be provided for each dipole antenna. In such a case, it is possible to implement a more specific directional pattern.

Fifth Embodiment

Figure 10:
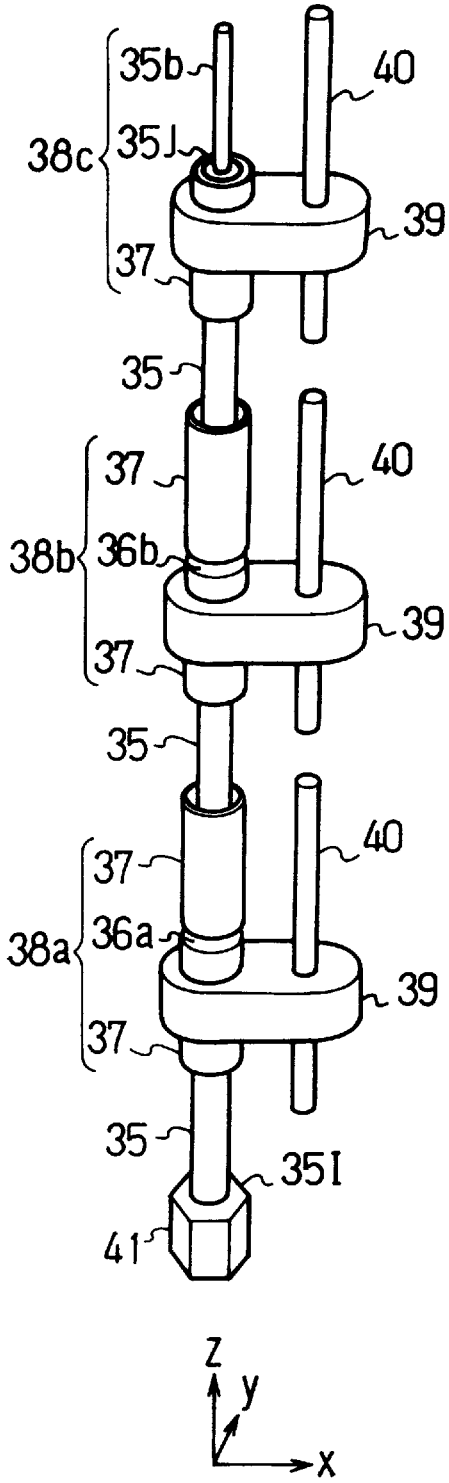
FIG. 10 is a perspective view of a fifth embodiment of a mobile radio antenna according to the present invention.
Figure 11:
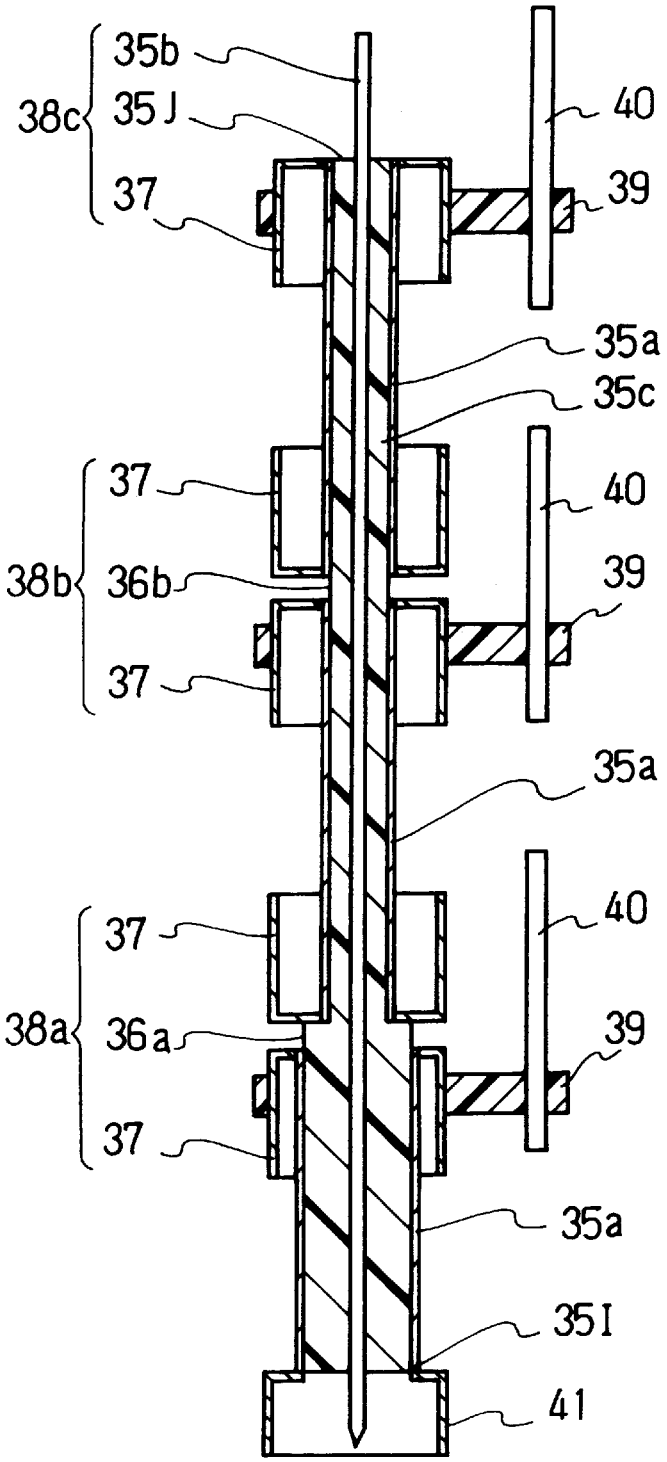
FIG. 11 is a vertical cross-sectional view of the fifth embodiment of the mobile radio antenna according to the present invention.

FIG. 10 is a perspective view of a fifth embodiment of a mobile radio antenna, and FIG. 11 is its vertical cross-sectional view. As shown in FIGS. 10 and 11, a coaxial feed line 35 comprises an outer conductor 35*a*, an inner conductor 35*b*, and a dielectric 35*c* which is filled between the inner wall of outer conductor 35*a* and inner conductor 35*b*. In outer conductor 35*a*, annular slits 36*a* and 36*b* are formed at a predetermined spacing. Here, annular slits 36*a* and 36*b* are formed by cutting outer conductor 35*a* in a circumferential direction. Outside outer conductor 35*a*, a pair of ¼-wavelength sleeve-like metal pipes 37 are located on both sides of each of annular slits 36*a* and 36*b*, forming dipole antenna elements 38*a* and 38*b*. In this example, the metal pipes 37 are connected to outer conductor 35*a* with their open ends facing away from annular slits 36*a* and 36*b*. Also, the other ends of the pair of metal pipes 37 are open. Also, outside outer conductor 35*a*, ¼-wavelength sleeve-like metal pipe 37 is located with one end connected to an upper end 35J of outer conductor 35*a* and the other end of metal pipe 37 is open. Inner conductor 35*b* of coaxial feed line 35 extends upward by a length corresponding to ¼ wavelength from upper end 35J of outer conductor 35*a*. Thus, the highest dipole antenna element 38*c* is formed. To the lower metal pipes 37 which form dipole antenna elements 38*a* and 38*b* and metal pipe 37 which forms dipole antenna element 38*c*, respectively, one end of arm-like spacer 39 is fixed. At the other end of each spacer 39, a stick-like passive element 40 is supported in parallel with each of dipole antenna elements 38*a*, 38*b* and 38*c*. At a lower end 35I of outer conductor 35*a* of coaxial feed line 35, a coaxial connector 41 for connection to an external circuit is provided. Thus, a colinear array antenna comprising three dipole antenna elements is formed.

In the colinear array antenna, the coaxial feed line 35 is formed so that the diameter of the feed line 35 from the lower annular slit 36*a* to lower end 35I is larger than the diameter of the feed line from annular slit 36*a* to upper end 35J. Thus, the characteristic impedance of coaxial feed line 35 on the upper end 35J side is lower than that of coaxial feed line 35 on the lower end 35I side, with annular slit 36*a* as a border.

Next, a colinear array antenna comprising three dipole antenna elements for use in a 1907±13 MHz band will be described. Metal pipe 37 is a cylinder having an inside diameter of 7.6 mm and an outside diameter of 8 mm and made of brass, and its length is set to 35 mm which is about a ¼ wavelength in the center of the band. Also, passive element 40 is a stick having a diameter of 3 mm and made of brass, and its length is set to 81 mm which is somewhat longer than a ½ wavelength in the center of the band. The length of this passive element 40 is a factor that determines the radiation pattern in the horizontal plane (xy plane). When the length of passive element 40 is longer than a ½ wavelength, it operates as a reflector. When the length of passive element 40 is shorter than a ½ wavelength, it operates as a wave director. Therefore, the length of passive element 40 is set according to the desired use. Here, the length is set so that passive element 40 is used as a reflector. Metal pipe 37 and passive element 40 are held by spacer 39 made of fluororesin (for example, polytetrafluoroethylene), and the center-to-center distance between both is set to 12 mm. As this distance becomes shorter, the respective radiation impedances of dipole antenna elements 38*a*, 38*b* and 38*c* become lower. Here, the spacing is set to achieve impedance matching as will be described below. Inner conductor 35*b* of coaxial feed line 35 is a copper wire having a diameter of 1.5 mm. Outer conductor 35*a* of coaxial feed line 35 is a copper cylinder having an inside diameter of 5.0 mm from the lower annular slit 36*a* to lower end 35J and an inside diameter of 1.9 mm from annular slit 36*a* to upper end 35J. Also, polytetrafluoroethylene having a dielectric constant of 2 is used as the dielectric 35*c* between outer conductor 35*a* and inner conductor 35*b*. Thus, the characteristic impedance of coaxial feed line 35 from annular slit 36*a* to lower end 35I is about 50 Ω, and the characteristic impedance of coaxial feed line 35 from annular slit 36*a* to upper end 35J is about 10 Ω. Annular slits 36*a* and 36*b* are each formed by cutting outer conductor 35*a* in a circumferentail direction with a width of 3 mm, and the spacing between both is set to 111 mm which is equal to a length corresponding to the wavelength of the radio wave propagating in coaxial feed line 35. Also, the spacing from the upper annular slit 36*b* to upper end 35J of outer conductor 35*a* is set to 111 mm. These annular slits 36*a* and 36*b* and upper end 35J of outer conductor 35*a* form the feed points of dipole antenna elements 38*a*, 38*b* and 38*c* respectively, and the respective spacings are factors that determine the radiation patterns in the vertical planes (yz plane and zx plane). In other words, when these spacings are longer than the wavelength of the radio wave propagating in coaxial feed line 35, the direction of the peak gain in vertical planes is tilted upward. When these spacings are shorter than the wavelength of the radio wave propagating in coaxial feed line 35, the direction of the peak gain in vertical planes is tilted downward. Therefore, the respective spacings between annular slits 36*a* and 36*b* and upper end 35J of outer conductor 35*a* are set according to the desired use. Here, these spacings are set so as to be equal to the wavelength of the radio wave propagating in coaxial feed line 35, and the direction of the peak gain in the vertical planes is in the horizontal direction. The entire length of the colinear array antenna is 330 mm.

Figure 12:
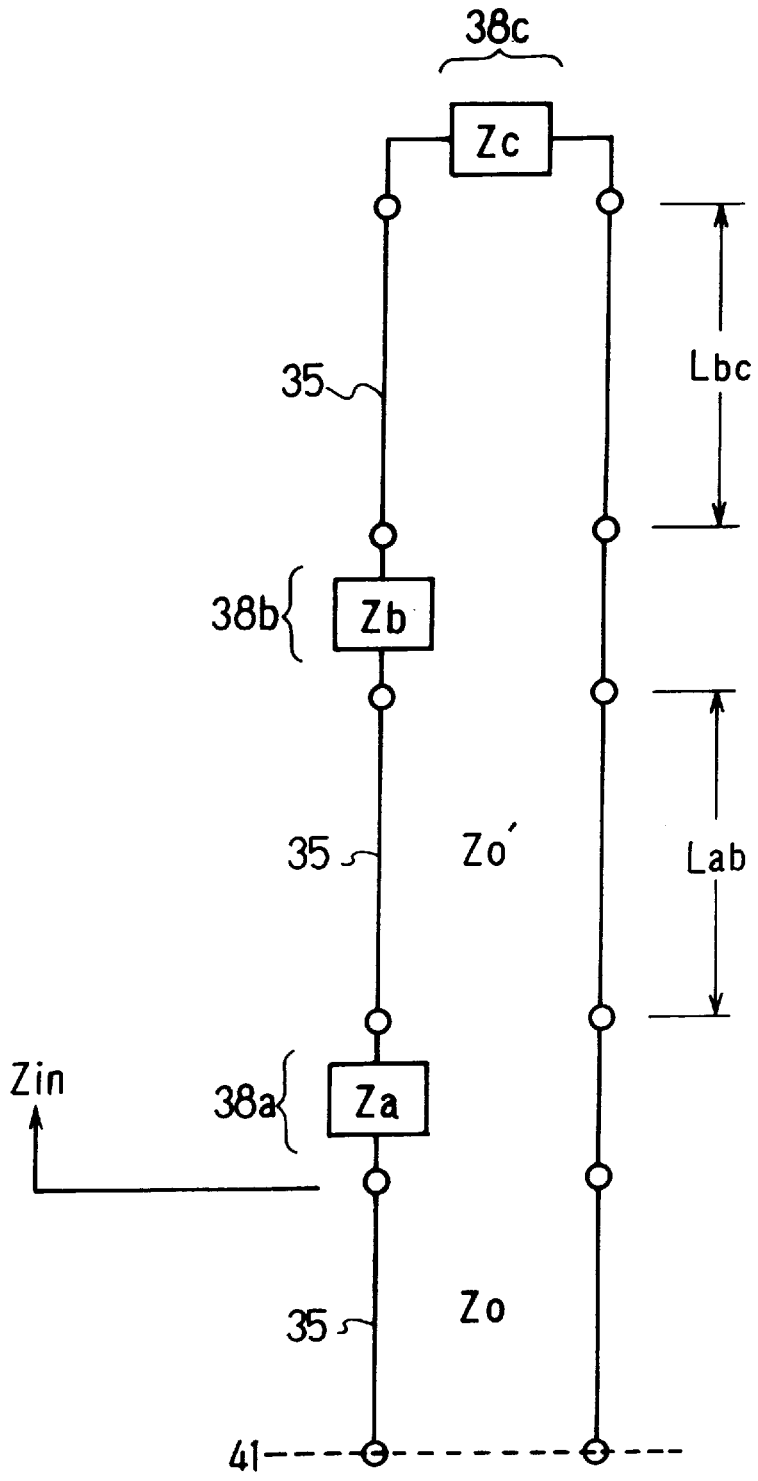
FIG. 12 shows an input equivalent circuit of the mobile radio antenna (colinear array antenna) in the fifth embodiment of the present invention.

FIG. 12 illustrates an input equivalent circuit of the colinear array antenna. As shown in FIG. 12, the input equivalent circuit of the colinear array antenna is such that radiation impedances $Z_a$, $Z_b$ and $Z_c$ of individual dipole antenna elements 38*a*, 38*b* and 38*c* are connected in series through coaxial feed line 35. Here, a spacing $L_{ab}$ between the feed points of dipole antenna elements 38*a* and 38*b* (that is, annular slits 36*a* and 36*b*) and a spacing $L_{bc}$ between the feed points of dipole antenna elements 38*b* and 38*c* (that is, annular slit 36*b* and upper end 35J of outer conductor 35*a*) are set to be equal to the wavelength of the radio wave propagating in coaxial feed line 35. Therefore, $Z_a$, $Z_b$ and $Z_c$ are added in phase at a center frequency of a band, and the value of impedance $Z_{in}$ seeing the other end 35J side from the lower dipole antenna element 38*a* (that is, the input impedance) is equal to the sum of $Z_a$, $Z_b$ and $Z_c$. In order to match this impedance with the standard impedance of a circuit system without using an impedance conversion circuit, the sum of $Z_a$, $Z_b$ and $Z_c$ needs to be set to the value equal to the standard impedance of 50 Ω. Since the radiation impedance of a common dipole antenna is about 70 Ω, which is too high, the value is lowered by providing passive element 40 in a suitable position, and impedances $Z_a$, $Z_b$ and $Z_c$ of dipole antenna elements 38*a*, 38*b* and 38*c* are each set to about 17 Ω (the standard impedance of 50 Ω divided by the number of elements, 3). In order to maintain the matching state of this impedance $Z_{in}$, characteristic impedance $Z_0$ of coaxial feed line 35 from the feed point of the lower dipole antenna element 38*a* (that is, annular slit 36*a*) to lower end 35I is set to 50 Ω which is equal to the standard impedance.

Figure 13:
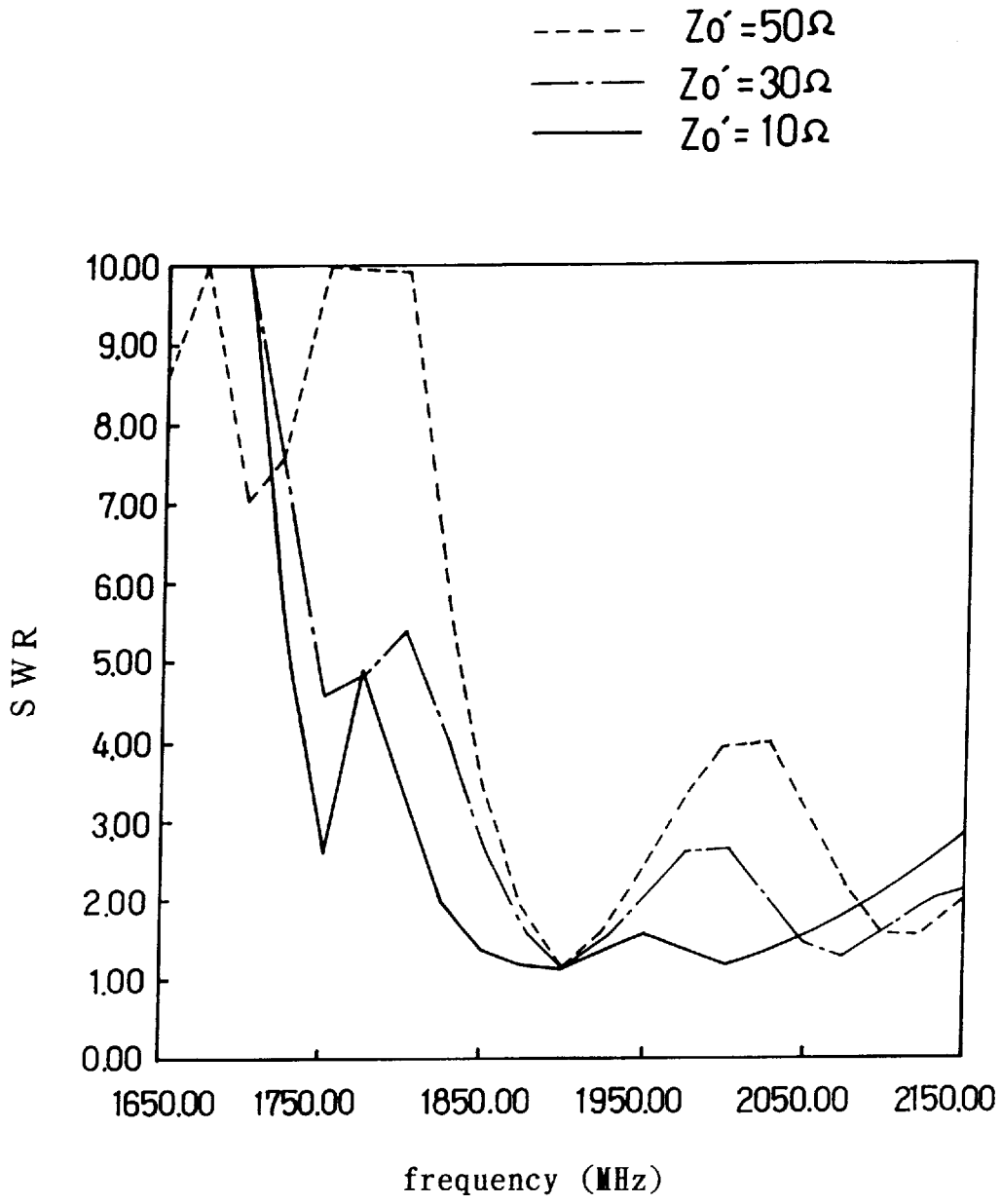
FIG. 13 is a frequency characteristic graph of the standing wave ratio (SWR) of the mobile radio antenna (colinear array antenna) in the fifth embodiment of the present invention.

FIG. 13 is a frequency characteristic graph of the standing wave ratio (SWR) of the colinear array antenna. As shown in FIG. 13, the SWR characteristics near the band of the colinear array antenna are changed by characteristic impedance $Z_0'$ of the coaxial feed line 35 connecting the dipole antennas 38*a*, 38*b* and 38*c* (see FIG. 12). As characteristic impedance $Z_0'$ of coaxial feed line 35 is decreased, the value of SWR near the band decreases, and therefore a broad band matching state can be obtained. As mentioned above, the values of radiation impedances $Z_a$, $Z_b$ and $Z_c$ of dipole antenna elements 38*a*, 38*b* and 38*c* in the center of the band are lower than the standard impedance. Therefore, by also lowering characteristic impedance $Z_0'$ of the coaxial feed line 35 connecting the dipole antenna elements 38*a*, 38*b* and 38*c* accordingly, both can be suitably balanced to obtain broad band matching characteristics. Thus, in order to obtain this effect, characteristic impedance $Z_0'$ of coaxial feed line 35 from the feed point of the lower dipole antenna element

38*a* (that is, annular slit 36*a*) to upper end 35J is set to 10 Ω, and broad band matching characteristics are implemented.

By forming the colinear array antenna as mentioned above, a small and simple structure can be made without using an impedance conversion circuit, and a SWR in a required band of 1.5 or lower can be achieved.

Figure 14:
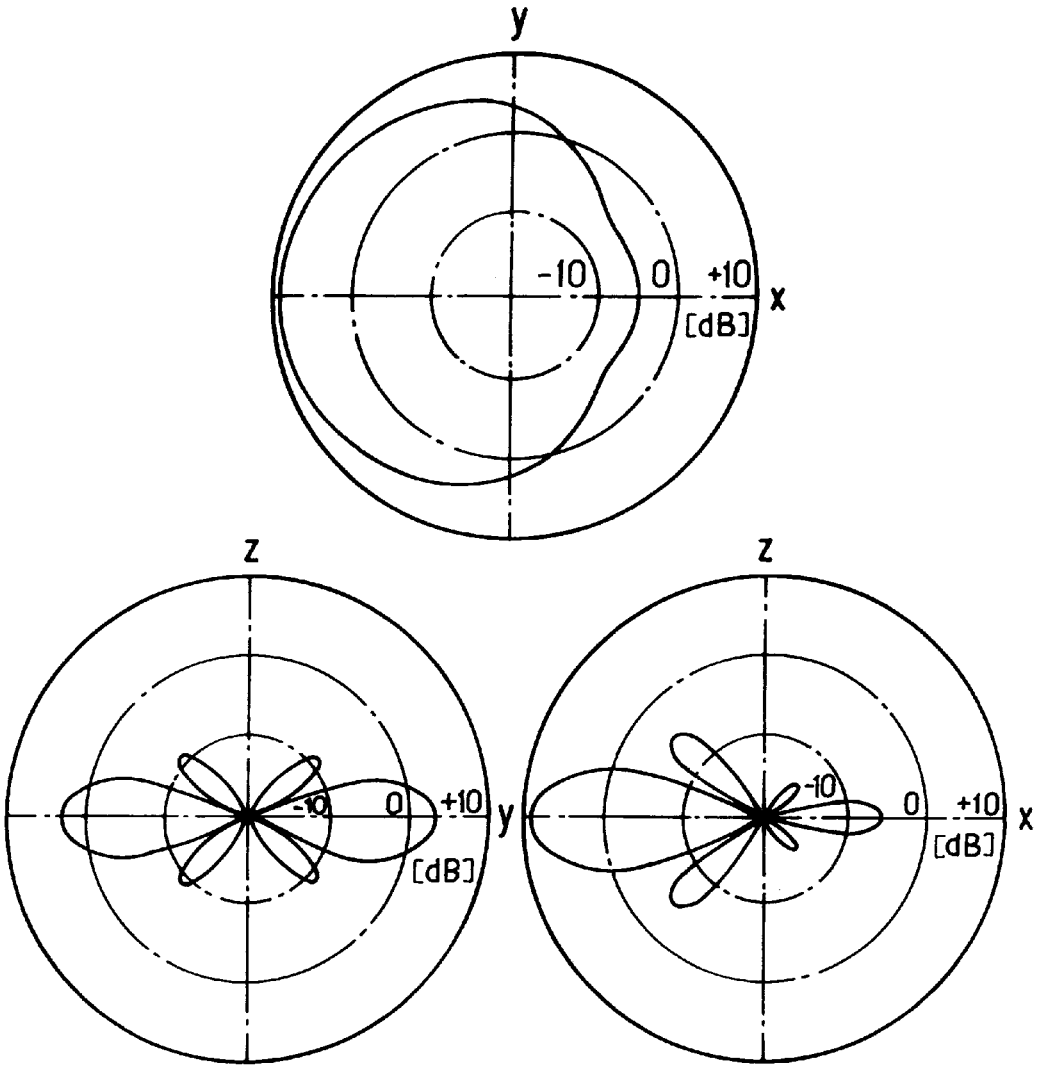
FIG. 14 is a characteristic graph showing radiation patterns at 1907 MHz of the mobile radio antenna (colinear array antenna) in the fifth embodiment of the present invention.
Figure 15:
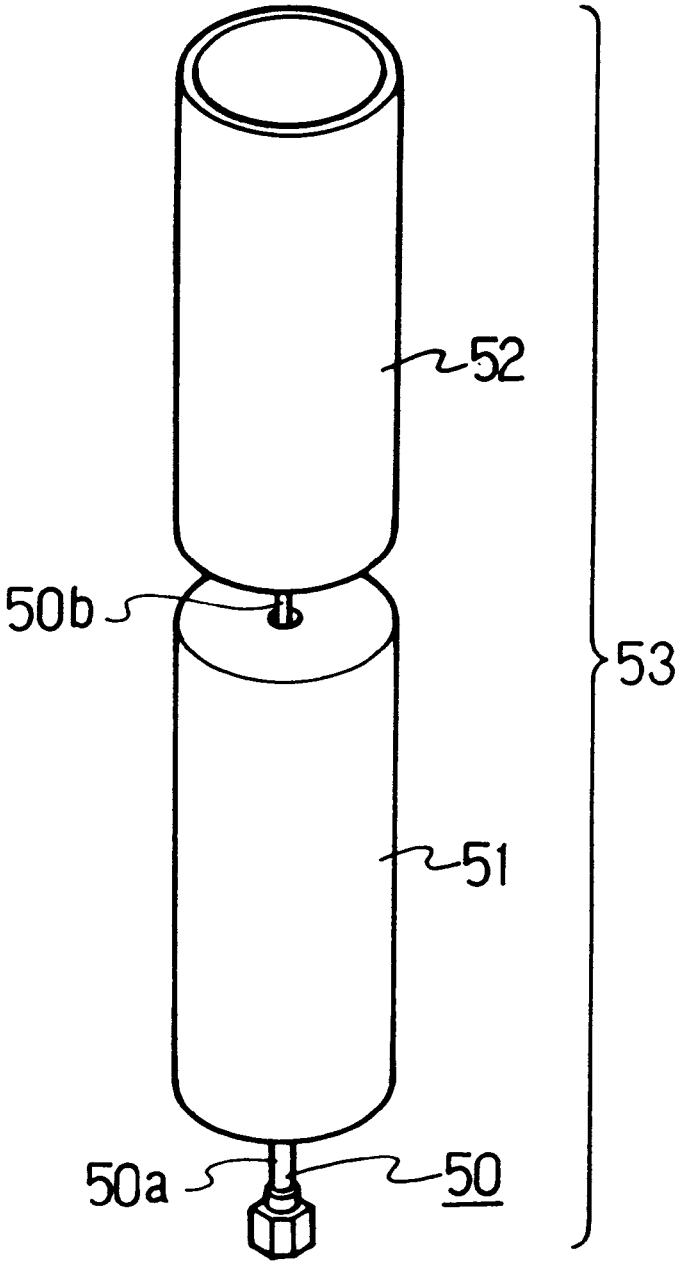
FIG. 15 (PRIOR ART)
FIG. 15 is a perspective view of an example of a sleeve antenna in the prior art.
Figure 16:
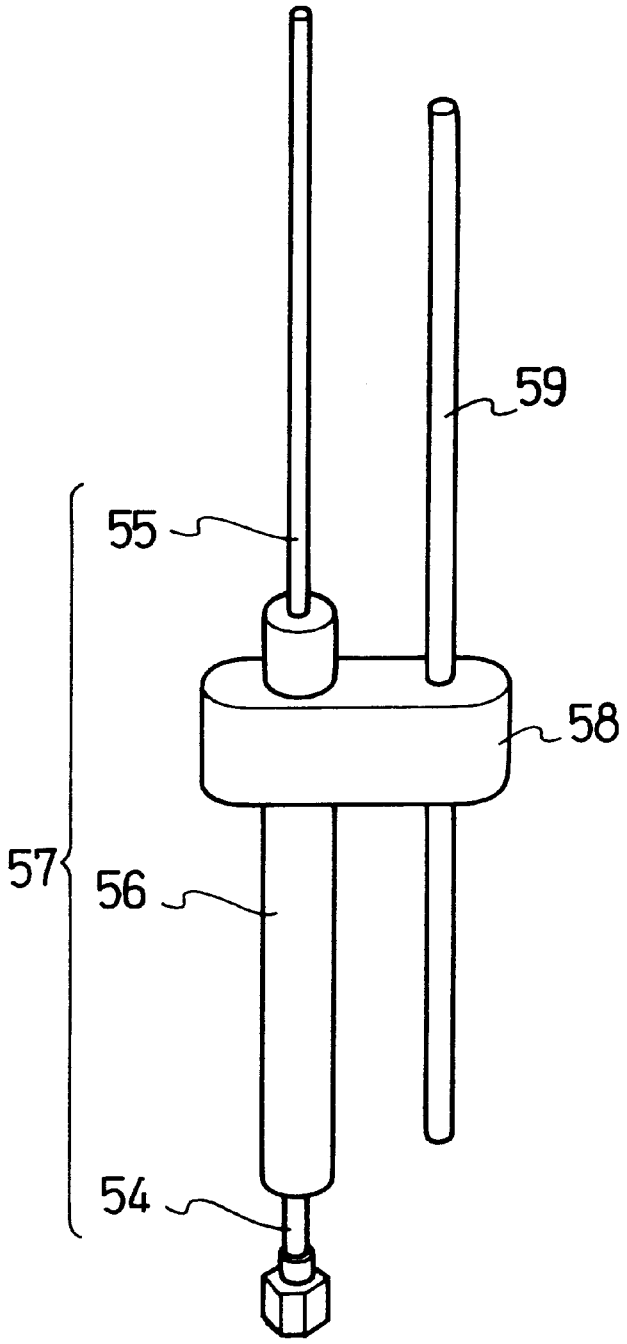
FIG. 16 (PRIOR ART)
FIG. 16 is a perspective view of another example of a sleeve antenna in the prior art.
Figure 17:
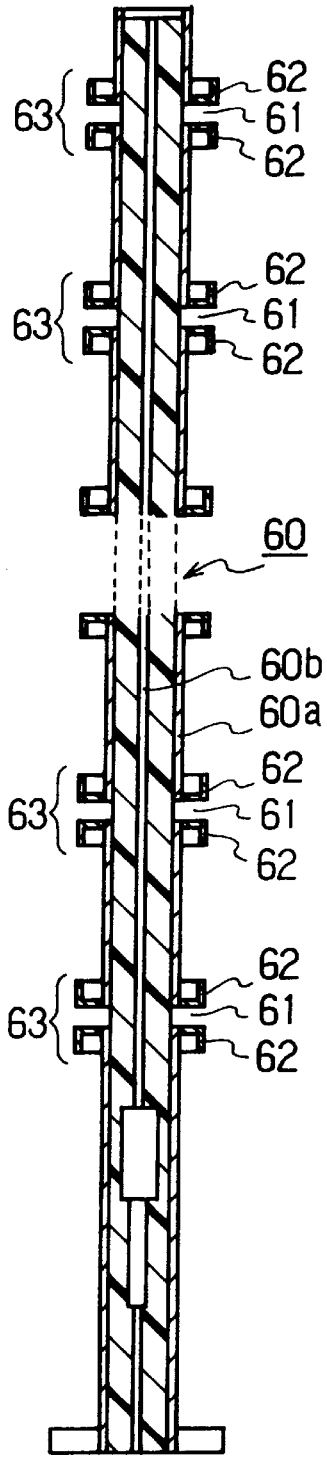
FIG. 17 (PRIOR ART)
FIG. 17 is a cross-sectional view of a colinear array antenna in the prior art.

FIG. 14 is a characteristic view showing the radiation patterns at 1907 MHz of the colinear array antenna. In FIG. 14, the longitudinal direction of the colinear array antenna is the z direction, the direction in which passive element 40 is provided is the x direction, and a direction that is rotated clockwise by 90° in a horizontal plane from the x direction is the y direction (see FIG. 10). As shown in FIG. 14, the radiation pattern in the xy plane (horizontal plane) shows peak gain in the −x direction, that is, the opposite direction to passive element 40. This indicates that passive element 40 operates as a reflector because the length of passive element 40 is set longer than a ½ wavelength. Also, the radiation patterns of the yz plane and zx plane (vertical planes) show that the direction of the peak gain is in the horizontal direction (the direction of the y axis or the z axis). This is because the spacing between the feed points of dipole antenna elements 38*a*, 38*b* and 38*c* is made equal to one wavelength.

By the structure as mentioned above, a peak gain of 10 dB or more can be obtained with a colinear array antenna comprising three dipole antenna elements. Thus, an antenna that shows a peak gain in a specific direction in the horizontal plane (an xy plane) is called a "sector antenna", and it is useful in limiting the communication area of a base station in a certain direction, in performing angle diversity by a plurality of antennas, etc.

Also, in this embodiment, the characteristic impedance of coaxial feed line 35 is changed with the lower annular slit 36*a* as a border. This is because radiation impedances $Z_a$, $Z_b$ and $Z_c$ of dipole antenna elements 38*a*, 38*b* and 38*c* are set approximately the same. If radiation impedances $Z_a$, $Z_b$ and $Z_c$ are different, the characteristic impedance may be changed with another annular slit as a border.

In this embodiment, the characteristic impedance of coaxial feed line 35 on the upper end 35J side is decreased by making the inside diameter of outer conductor 35*a* from the lower annular slit 36*a* to upper end 35J smaller. However, the structure need not be limited to this structure. For example, the characteristic impedance of coaxial feed line 35 on the upper end 35J side may be decreased by making the diameter of inner conductor 35*b* from the lower annular slit 36*a* to upper end 35J larger, or the characteristic impedance of coaxial feed line 35 on the upper end 35J side may be decreased by setting the permittivity of the dielectric filled from the lower annular slit 36*a* to upper end 35J higher.

The invention may be embodied in other forms without departing from the spirit or essential characteristics thereof. The embodiments disclosed in this application are to be considered in all respects as illustrative by the appended claims rather than by the foregoing description, and all changes which come within the meaning and range of equivalency of the claims are intended to be embraced therein.

What is claimed is:

1. A mobile radio antenna comprising:

a dipole antenna having a coaxial feed line formed of an outer conductor and an inner conductor that are concentrically located with a dielectric therebetween, an antenna element formed by extending the inner conductor upward by a length corresponding to approximately a ¼-wavelength from the upper end of the outer conductor, and a ¼-wavelength sleeve conductor having a closed end and an open end located outside the coaxial feed line with the closed end connected to the outer conductor; and an insulating spacer interposed between an inner wall of the sleeve conductor and the coaxial feed line at the open end of the sleeve conductor, wherein the insulating spacer is configured to control a resonance frequency of the dipole antenna by adjusting an insertion depth of the insulating spacer, and wherein the resonance frequency is decreased by increasing the insertion depth of the insulating spacer and the resonance frequency is increased by decreasing the insertion depth of the insulating spacer.

2. The mobile radio antenna according to claim 1, wherein an internal thread is formed on a part of the inner wall of the sleeve conductor at the open end by tapping or drawing, and an external thread is formed around a periphery of the insulating spacer.

3. The mobile radio antenna according to claim 1, wherein a plurality of steps are provided on a part of the inner wall of the sleeve conductor at the open end, and a tip end of the insulating spacer is configured to form a snap fit with the open end of the sleeve conductor.

4. A mobile radio antenna comprising:

a straight dipole antenna having a coaxial feed line formed of an outer conductor and an inner conductor that are concentrically located with a dielectric therebetween, an annular slit provided in a predetermined position of the outer conductor as a feed points, and a pair of ¼-wavelength sleeve conductors each having an open end and a closed end with their closed ends opposed and connected to both sides of the annular slit of the outer conductor; and a pair of insulating spacers interposed between inner walls of the pair of sleeve conductors and the coaxial feed line at the open ends of the sleeve conductors, wherein the pair of insulating spacers is configured to control a resonance frequency of the dipole antenna by adjusting insertion depths of the pair of insulating spacers, and wherein the coaxial feed line, the annular slit and the pair of ¼-wavelength sleeve conductors are collinearly connected to form the straight dipole antenna.

5. The mobile radio antenna according to claim 4, wherein an internal thread is formed on a part of the inner wall of the sleeve conductor at the open end by tapping or drawing, and an external thread is formed around a periphery of the insulating spacer.

6. The mobile radio antenna according to claim 4, wherein a plurality of steps are provided on a part of the inner wall of the sleeve conductor at the open end, and a tip end of the insulating spacer is configured to form a snap fit with the open end of the sleeve conductor.

7. A mobile radio antenna, when the mobile radio antenna of claim 1 is a first mobile radio antenna, or the mobile radio antenna of claim 4 is a second mobile radio antenna, comprising:

the first mobile radio antenna; and at least one second mobile radio antenna connected to the insulating spacer side of the first mobile radio antenna, wherein the coaxial feed line, the annular slit and the pair of ¼-wavelength sleeve conductors are collinearly connected in the second mobile radio antenna.

8. A radio antenna comprising:

a coaxial feed line formed of an outer conductor and an inner conductor that are concentrically located with a dielectric therebetween;

at least one straight dipole antenna including an annular slit provided in a predetermined position of the outer conductor as a feed point and a pair of ¼-wavelength sleeve conductors fed by the coaxial feed line;

at least one passive element located near the dipole antenna; and a radome covering the dipole antenna and the passive element, wherein the passive element is supported by the radome, and wherein the coaxial feed line, the annular slit and the pair of ¼-wavelength sleeve conductors are collinearly connected to form the straight dipole antenna.

9. The mobile radio antenna according to claim 8, wherein the radome is formed in a cylindrical shape extending in the longitudinal direction of the dipole antenna, a bottom wall of the radome is fixed to a lower end part of the coaxial feed line, and a tip end part of the dipole antenna is inserted in a recess provided on a top wall of the radome.

10. The mobile radio antenna according to claim 8, wherein one of the pair of ¼-wavelength sleeve conductors is formed by extending the inner conductor of the coaxial feed line upward by a length corresponding to approximately ¼ wavelength from an upper end of the outer conductor, and the other of the pair of ¼-wavelength sleeve conductors is located outside the coaxial feed line with one end of the sleeve conductor connected to the upper end of the outer conductor.

11. The mobile radio antenna according to claim 8, wherein the annular slit is provided in a predetermined position of the outer conductor of the coaxial feed line as a feed point, and each of the pair of ¼-wavelength sleeve conductors has an open end and a closed end with their closed ends opposed and connected to the outer conductor on both sides of the annular slit.

12. The mobile radio antenna according to claim 8, wherein the passive element is a metal body adhered to an inner wall surface of the radome.

13. The mobile radio antenna according to claim 8, wherein the passive element is a metal body integrally formed in the radome.

14. The mobile radio antenna according to claim 8, wherein the passive element is a metal body formed on an inner wall surface of the radome by printing or plating.

15. The mobile radio antenna according to claim 8, wherein the passive element is formed by affixing a resin film on which a metal body is formed by printing or plating to an inner wall surface of the radome.

16. A mobile radio antenna comprising:

a coaxial feed line formed of an outer conductor and an inner conductor that are concentrically located with a dielectric therebetween;

a plurality of annular slits provided in the outer conductor at predetermined spacing; and a plurality of antenna elements formed by locating a pair of ¼-wavelength sleeve conductors each having an open end and a closed end with their closed ends opposed and connected to both sides of the plurality of annular slits, wherein a characteristic impedance of the coaxial feed line changes along a length of the feed line with at least one of the plurality of annular slits as a border, and wherein the coaxial feed line, the plurality of annular slits and the pair of ¼-wavelength sleeve conductors are collinearly connected to form a straight dipole antenna.

17. The mobile radio antenna according to claim 16, wherein the plurality of antenna elements have at least one passive element provided for each.

18. The mobile radio antenna according to claim 16, wherein, the characteristic impedance from one end of the coaxial feed line to an annular slit that is the nearest to the one end of the coaxial feed line is set as standard impedance, and characteristic impedance from the annular slit that is the nearest to the one end of the coaxial feed line to the other end of the coaxial feed line is lower than the standard impedance.

19. The mobile radio antenna according to claim 18, wherein the characteristic impedance from the annular slit that is the nearest to the one end of the coaxial feed line to the other end of the coaxial feed line is constant.

* * * * *